US008512179B2

(12) United States Patent
Pulkrabek et al.

(10) Patent No.: US 8,512,179 B2
(45) **Date of Patent: *Aug. 20, 2013**

(54) EXPANDABLE BROADHEAD WITH REAR DEPLOYING BLADES

(75) Inventors: Larry R. Pulkrabek, Cloquet, MN (US); William Edward Pedersen, Duluth, MN (US); Bruce Barrie, Waseca, MN (US)

(73) Assignee: Out RAGE, LLC, Proctor, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/442,363

(22) Filed: Apr. 9, 2012

(65) Prior Publication Data

US 2012/0220400 A1 Aug. 30, 2012

Related U.S. Application Data

(63) Continuation of application No. 12/828,832, filed on Jul. 1, 2010, now Pat. No. 8,197,367, which is a continuation of application No. 11/533,998, filed on Sep. 21, 2006, now Pat. No. 7,771,298.

(60) Provisional application No. 60/822,873, filed on Aug. 18, 2006.

(51) Int. Cl.
*F42B 6/08* (2006.01)

(52) U.S. Cl.
USPC ..... 473/583

(58) Field of Classification Search
USPC ..... 473/582, 583, 584
See application file for complete search history.

(56) References Cited

U.S. PATENT DOCUMENTS

| | | | |
|---|---|---|---|
| 2,212,345 | A | 8/1940 | Krieger |
| 2,289,284 | A | 7/1942 | Chandler |
| 2,568,417 | A | 9/1951 | Steinbacher |
| 2,684,852 | A | 7/1954 | Romeka |
| 2,816,765 | A | 12/1957 | Stockfleth |
| 2,859,970 | A | 11/1958 | Doonan |
| 2,925,278 | A | 2/1960 | Sweetland |
| 2,930,620 | A | 3/1960 | Brooks |
| 2,939,708 | A | 6/1960 | Scheib |
| 2,940,758 | A | 6/1960 | Richter |
| 3,000,635 | A | 9/1961 | Nieman |
| 3,036,395 | A | 5/1962 | Nelson |
| 3,138,383 | A | 6/1964 | McKinzie |
| 3,527,463 | A | 9/1970 | Turner |
| 3,578,328 | A | 5/1971 | Rickey |

(Continued)

OTHER PUBLICATIONS

Petition Under 37 C.F.R. § 1.182 and/or § 1.183, a Protest Under 37 C.F.R. § 1.291(a) with Exhibits 1-5, and Declaration of Robert Mizek Under 37 C.F.R. §1.132, initially submitted to the USPTO on Jan. 31, 2012 by Mr. Allan A. Fanucci.

(Continued)

*Primary Examiner* — John Ricci
(74) *Attorney, Agent, or Firm* — Covington & Burling LLP; Andrea G. Reister; Gregory S. Discher

(57) ABSTRACT

An improved expandable broadhead with rear deploying blades. The rear deploying blades deploy reliably upon impact of the blades with a target. The expandable broadhead resists deflection by the target regardless of the angle of entry. Consequently, the present expandable broadhead maximizes kinetic energy on impact and increases the probability of substantial penetration into the target.

3 Claims, 20 Drawing Sheets

(56) References Cited

U.S. PATENT DOCUMENTS

| | | | |
|---|---|---|---|
| 3,618,948 | A | 11/1971 | McGlocklin |
| 3,653,664 | A | 4/1972 | Gentellalli |
| 3,672,677 | A | 6/1972 | Moore |
| 3,738,657 | A | 6/1973 | Cox |
| 3,741,542 | A | 6/1973 | Karbo |
| 3,756,600 | A | 9/1973 | Maleski |
| 3,759,519 | A | 9/1973 | Palma |
| 3,854,723 | A | 12/1974 | Wilson |
| 3,881,730 | A | 5/1975 | Carella |
| 3,893,866 | A | 7/1975 | Hollingsworth |
| 3,897,062 | A | 7/1975 | Christensen |
| 3,910,579 | A | 10/1975 | Sprandel |
| 3,915,455 | A | 10/1975 | Savora |
| 3,941,059 | A | 3/1976 | Cobb |
| 4,006,901 | A | 2/1977 | Simo |
| 4,029,319 | A | 6/1977 | Christen |
| 4,036,499 | A | 7/1977 | Sherwin |
| 4,043,020 | A | 8/1977 | Hoggard |
| 4,093,230 | A | 6/1978 | Simo |
| 4,099,720 | A | 7/1978 | Zeren |
| 4,141,554 | A | 2/1979 | Sherwin |
| 4,146,226 | A | 3/1979 | Sorensen |
| 4,166,619 | A | 9/1979 | Bergmann et al. |
| 4,203,601 | A | 5/1980 | Simo |
| 4,210,330 | A | 7/1980 | Kosbab |
| 4,234,191 | A | 11/1980 | Erlandson |
| 4,254,958 | A | 3/1981 | Bateman, III |
| 4,341,391 | A | 7/1982 | Anderson |
| 4,381,866 | A | 5/1983 | Simo |
| 4,405,133 | A | 9/1983 | Cartwright, Jr. |
| 4,410,184 | A | 10/1983 | Anderson |
| 4,452,460 | A | 6/1984 | Adams |
| 4,505,482 | A | 3/1985 | Martin, Sr. |
| 4,529,208 | A | 7/1985 | Simo |
| 4,534,568 | A | 8/1985 | Tone |
| 4,558,868 | A | 12/1985 | Musacchia |
| 4,565,377 | A | 1/1986 | Troncoso, Jr. et al. |
| 4,576,589 | A | 3/1986 | Kraus et al. |
| 4,579,348 | A | 4/1986 | Jones |
| 4,601,710 | A | 7/1986 | Moll |
| 4,615,529 | A | 10/1986 | Vocal |
| 4,616,835 | A | 10/1986 | Trotter |
| 4,621,817 | A | 11/1986 | Musacchia |
| 4,643,435 | A | 2/1987 | Musacchia |
| 4,671,517 | A | 6/1987 | Winters |
| 4,676,512 | A | 6/1987 | Simo |
| 4,729,320 | A | 3/1988 | Whitten, III |
| 4,742,637 | A | 5/1988 | Musacchia |
| 4,807,889 | A | 2/1989 | Johnson |
| 4,924,619 | A | 5/1990 | Dowell |
| 4,932,671 | A | 6/1990 | Anderson, Jr. |
| 4,940,246 | A | 7/1990 | Stagg |
| 4,973,060 | A | 11/1990 | Herzing |
| 4,976,443 | A | 12/1990 | DeLucia |
| 4,986,550 | A | 1/1991 | Segovia |
| 4,998,738 | A | 3/1991 | Puckett |
| 5,033,220 | A | 7/1991 | Phelps |
| 5,044,640 | A | 9/1991 | DelMonte et al. |
| 5,046,744 | A | 9/1991 | Eddy |
| 5,057,082 | A | 10/1991 | Burchette, Jr. |
| 5,064,202 | A | 11/1991 | Barner |
| 5,066,021 | A | 11/1991 | DeLucia |
| 5,078,407 | A | 1/1992 | Carlston et al. |
| 5,082,292 | A | 1/1992 | Puckett et al. |
| 5,083,798 | A | 1/1992 | Massey |
| 5,090,709 | A | 2/1992 | Johnson |
| 5,100,143 | A | 3/1992 | Puckett |
| 5,102,147 | A | 4/1992 | Szeluga |
| 5,112,063 | A | 5/1992 | Puckett |
| D326,889 | S | 6/1992 | Garoutte |
| 5,137,282 | A | 8/1992 | Segar et al. |
| 5,160,148 | A | 11/1992 | Musacchia, Sr. |
| 5,172,916 | A | 12/1992 | Puckett |
| 5,178,398 | A | 1/1993 | Eddy |
| 5,178,399 | A | 1/1993 | Garoutte |
| 5,188,373 | A | 2/1993 | Ferguson et al. |
| D342,303 | S | 12/1993 | Johnson |
| 5,286,035 | A | 2/1994 | Ward |
| 5,322,297 | A | 6/1994 | Smith |
| 5,342,382 | A | 8/1994 | Brinkerhoff et al. |
| 5,372,588 | A | 12/1994 | Farley et al. |
| 5,385,572 | A | 1/1995 | Nobles et al. |
| 5,417,440 | A | 5/1995 | Barrie et al. |
| 5,439,231 | A | 8/1995 | Roberts et al. |
| D363,108 | S | 10/1995 | Johnson |
| 5,458,341 | A | 10/1995 | Forrest et al. |
| 5,472,213 | A | 12/1995 | Dudley |
| 5,482,293 | A | 1/1996 | Lekavich |
| 5,482,294 | A | 1/1996 | Sullivan et al. |
| 5,496,042 | A | 3/1996 | Craft et al. |
| 5,496,043 | A | 3/1996 | Ester |
| D370,246 | S | 5/1996 | Johnson |
| 5,564,713 | A | 10/1996 | Mizek et al. |
| 5,624,459 | A | 4/1997 | Kortenbach et al. |
| 5,636,845 | A | 6/1997 | Newnam |
| 5,649,706 | A | 7/1997 | Treat, Jr. et al. |
| D385,327 | S | 10/1997 | Delmonte |
| 5,803,844 | A | 9/1998 | Anderson |
| 5,803,845 | A | 9/1998 | Anderson |
| 5,820,498 | A | 10/1998 | Maleski |
| 5,857,930 | A | 1/1999 | Troncoso |
| 5,871,410 | A | 2/1999 | Simo et al. |
| 5,879,252 | A | 3/1999 | Johnson |
| 5,931,751 | A | 8/1999 | Cooper |
| 5,941,784 | A | 8/1999 | Mizek |
| 6,015,357 | A | 1/2000 | Rizza |
| 6,027,421 | A | 2/2000 | Adams, Jr. |
| 6,077,179 | A | 6/2000 | Liechty, II |
| 6,165,086 | A | 12/2000 | Liechty, II |
| 6,172,206 | B1 | 1/2001 | Schneider et al. |
| 6,174,252 | B1 | 1/2001 | Mizek |
| 6,200,237 | B1 | 3/2001 | Barrie |
| 6,217,467 | B1 | 4/2001 | Maleski |
| 6,258,000 | B1 | 7/2001 | Liechty, II |
| 6,270,435 | B1 | 8/2001 | Sodaro |
| 6,283,880 | B1 | 9/2001 | Barrie |
| 6,287,223 | B1 | 9/2001 | Liechty, II |
| 6,287,244 | B1 | 9/2001 | Boos |
| 6,290,903 | B1 | 9/2001 | Grace, Jr. et al. |
| 6,306,053 | B1 | 10/2001 | Liechty, II |
| 6,319,161 | B1 | 11/2001 | Martinez et al. |
| 6,322,464 | B1 | 11/2001 | Sestak |
| 6,394,919 | B1 | 5/2002 | Ossege |
| 6,398,676 | B1 | 6/2002 | Mizek |
| 6,428,433 | B1 | 8/2002 | Liechty, II |
| 6,428,434 | B1 | 8/2002 | Liechty, II |
| 6,517,454 | B2 | 2/2003 | Barrie et al. |
| 6,530,853 | B1 | 3/2003 | Giannetti |
| 6,540,628 | B1 | 4/2003 | Musacchia, Jr. |
| 6,554,727 | B1 | 4/2003 | Armstrong et al. |
| 6,558,280 | B1 | 5/2003 | Kuhn |
| 6,595,881 | B1 | 7/2003 | Grace, Jr. et al. |
| 6,626,776 | B2 | 9/2003 | Barrie et al. |
| 6,663,518 | B1 | 12/2003 | Kuhn |
| 6,669,586 | B2 | 12/2003 | Barrie et al. |
| 6,684,741 | B2 | 2/2004 | Blackston |
| 6,695,726 | B1 | 2/2004 | Kuhn |
| 6,695,727 | B1 | 2/2004 | Kuhn |
| 6,726,581 | B2 | 4/2004 | Muller |
| 6,739,991 | B1 | 5/2004 | Wardropper |
| 6,743,128 | B2 | 6/2004 | Liechty, II |
| 6,749,801 | B1 | 6/2004 | Grace, Jr. et al. |
| 6,755,758 | B2 | 6/2004 | Liechty, II |
| 6,793,596 | B1 | 9/2004 | Sullivan et al. |
| 6,830,523 | B1 | 12/2004 | Kuhn |
| 6,910,979 | B2 | 6/2005 | Barrie et al. |
| 6,918,848 | B2 | 7/2005 | Kuhn |
| 6,935,976 | B1 | 8/2005 | Grace, Jr. et al. |
| 6,939,258 | B2 | 9/2005 | Muller |
| 6,942,551 | B2 | 9/2005 | Mizek et al. |
| 6,942,588 | B2 | 9/2005 | Barrie |
| 6,997,827 | B1 | 2/2006 | Grace, Jr. et al. |
| 7,025,697 | B2 | 4/2006 | Mizek et al. |
| 7,037,222 | B2 | 5/2006 | Mizek et al. |

| | | | | |
|---|---|---|---|---|
| 7,234,220 | B1 | 6/2007 | Grace, Jr. | |
| 7,771,298 | B2 | 8/2010 | Pulkrabek | |
| 8,197,367 | B2 * | 6/2012 | Pulkrabek et al. | 473/583 |
| 2001/0006916 | A1 | 7/2001 | Liechty | |
| 2001/0036876 | A1 | 11/2001 | Barrie et al. | |
| 2002/0055404 | A1 | 5/2002 | Liechty | |
| 2002/0065155 | A1 | 5/2002 | Liechty | |
| 2002/0098926 | A1 | 7/2002 | Liechty | |
| 2002/0128096 | A1 | 9/2002 | Muller | |
| 2002/0151394 | A1 | 10/2002 | Arasmith | |
| 2003/0004021 | A1 | 1/2003 | Barrie et al. | |
| 2003/0022741 | A1 | 1/2003 | Muller | |
| 2003/0073525 | A1 | 4/2003 | Liechty | |
| 2003/0153417 | A1 | 8/2003 | Barrie et al. | |
| 2003/0236141 | A1 | 12/2003 | Kuhn | |
| 2004/0048704 | A1 | 3/2004 | Arasmith | |
| 2004/0092342 | A1 | 5/2004 | Perkins | |
| 2004/0138016 | A1 | 7/2004 | Kuhn | |
| 2004/0142778 | A1 | 7/2004 | Mizek et al. | |
| 2004/0198540 | A1 | 10/2004 | Mizek et al. | |
| 2006/0052191 | A1 | 3/2006 | Mizek et al. | |

OTHER PUBLICATIONS

Two photographs which are duplications of original photograph, taken of expandable broadheads of the same construction as those that were shown in the photograph provided with the email from rmizek@newarchery to B. Barrie, dated Jan. 30, 2001.

Resubmission of email from rmizek@newarchery to B. Barrie, re: AMO SHOW; email dated Jan. 30, 2001.

"New Products for 1997," Rich Walton's Industry News, 9pp., http://www.bowhunting.net/richwalton/7newproducts.html.

"Bowhunting Tactics," Petersen's Bowhunting Magazine, Oct. 18, 2004, 5 pp., www.outdoorsbest.com.

"Broadhead Collecting—As Easy As A.B.C.C.," Stickbow.com, 2002, 8 pp.

Bowhunting Equipment Buyer's Guide, 1997, 3 pp.

Bowhunting World, Feb. 1997, 2 pp.

Bowhunting World: Equipment Guide '94, vol. 43, No. 5, Jul. 1994, 3 pp.

Bowhunting World: Bowhunting Guide '89-'90, vol. 38, No. 7, 2 pp.

Office Action issued in U.S. Appl. No. 11/823,458 dated Oct. 28, 2008.

Office Action (final) issued in U.S. Appl. No. 11/823,458 dated May 29, 2009.

Advisory Action issued in U.S. Appl. No. 11/823,458 dated Jul. 24, 2009.

Advisory Action issued in U.S. Appl. No. 11/823,458 dated Sep. 10, 2009.

Office Action issued in U.S. Appl. No. 11/823,458 dated Feb. 4, 2010.

E-mail from rmizek@newarchery to B. Barrie, re: AMO SHOW; Jan. 30, 2001.

New Archery Products Corp. ("NAP"), letter to R. Krause regarding NAP's interest in Patent Nos. 6,517,454, 6,626,776, and 6,910,979; letter dated Jul. 22, 2011.

R. L. Rainey letter to Andy Simo regarding, letter Andy sent on Jul. 22, 2011 relating to a request for a worldwide, exclusive, royalty-free, and fully-paid-up license to these patents (6,517,454;6,626,776; and 6,910,979 as well as other patents formerly owned by Field Logic, Inc. Aug. 1, 2011.

D. H. Pauley, Letter to R. Rainey regarding: U.S. Appl. No. 11/823,458, Aug. 2, 2011.

J. Fowler e-mail to R. Rainey regarding OutRage/NAP (NA-9181) dated Aug. 19, 2011, forwarded to Greg Discher on Aug. 19, 2011.

R. L. Rainey letter to D. H. Pauley regarding, materials sent by D.H. Pauley on Aug. 2, 2011 relating to the New Archery Products' ("NAP's") request for a license to the patents owner by OutRage, LLC. Aug. 17, 2011.

D. H. Pauley, Letter to R. Rainey regarding: U.S. Appl. No. 11/823,458, Aug. 31, 2011.

Declaration of Bob Mizek to Establish date of Invention Prior to Critical date in US371 in U.S. Appl. No. 11/823,458 dated Aug. 31, 2011.

Declaration of Andy Simo to Establish date of Invention Prior to Critical date in US371 in U.S. Appl. No. 11/823,458 dated Aug. 31, 2011.

Declaration of Chris Kozlik to Establish date of Invention Prior to Critical date in US371 in U.S. Appl. No. 11/823,458 dated Aug. 31, 2011.

G. Discher, E-mail from Pauley Doug, regarding: NAP Instructions to begin preparing a Request for Inter Partes Reexamination for U.S. Patent 6,910,979; Sep. 13, 2011.

R. Krause, E-mail from Andy Simo, regarding: a resolution to a potentially serious patent conflict relating to the '979 Patent; Sep. 14, 2011.

A. Simo, E-mail from Rich Krause regarding: meeting request prior to NAP filing a Request for Reexamination; Sep. 16, 2011.

R. Krause, E-mail from Andy Simo, regarding: a proposed license agreement for both party to review; Sep. 19, 2011.

A. Simo, E-mail from Rich Krause, regarding: request for the proposed "no-charge license agreement" for the Out Rage Patent; Sep. 20, 2011.

R. Krause, E-mail from Andy Simo, regarding: requested proposed license agreement furnished per request; Sep. 22, 2011.

E-mail from Andy Simo to Rich Krause, dated Sep. 28, 2011.

2 E-mails: 1st e-mail from Rich Krause to Andy Simo, dated Sep. 28, 2011; 2nd e-mail from Andy Simo to Rich Klause, dated Sep. 29, 2011.

* cited by examiner

EXPANDABLE BROADHEAD WITH REAR DEPLOYING BLADES

The present application is a continuation of U.S. patent Ser. No. 12/828,832, entitled Expandable Broadhead with Rear Deploying Blades, filed Jul. 1, 2010, which is a continuation of U.S. patent Ser. No. 11/533,998, entitled Expandable Broadhead with Rear Deploying Blades, filed Sep. 21, 2006, now U.S. Pat. No. 7,771,298, which claims the benefit of U.S. Provisional Application No. 60/822,873 entitled Expandable Broadhead with Rear Deploying Blades, filed Aug. 18, 2006, all of which are hereby incorporated by reference.

FIELD OF THE INVENTION

The present invention relates to an improved expandable broadhead with rear deploying blades. The rear deploying blades have an in-flight retracted configuration and an expanded deployed configuration upon striking a target.

BACKGROUND OF THE INVENTION

In the archery industry, many manufacturers have attempted to simultaneously achieve an arrowhead that has aerodynamic properties similar to those associated with non-bladed arrowheads known as field points or nib points, while also achieving effective cutting areas provided by bladed arrowheads, which are often referred to as broadheads. Broadhead blades which are exposed during flight often result in undesirable steering of the front portion of the arrow, causing the arrow to deviate from a perfect flight path that coincides with a longitudinal axis of the arrow shaft, when loaded or drawn within an archery bow.

By reducing the surface area of a broadhead blade, the undesirable steering effects can be reduced. However, by reducing the surface area of a blade, the cutting area within a target or game is also reduced, resulting in a less effective entrance and exit wound.

Conventional blade-opening arrowheads have been designed so that a substantial portion of the blade is hidden within the body of the arrowhead, such as during flight of the arrow. Upon impact, such blades are designed to open and thereby expose a cutting surface or sharp edge of the blade. When the blades of such conventional arrowheads are closed and substantially hidden within the body, the exposed, surface area is reduced and thus produces relatively less undesirable steering effects.

Many of such conventional blade-opening arrowheads rely upon complex mechanisms, some of which fail to open reliably because of a significant holding or closing force that must be overcome, and others that open prematurely because of structural deficiencies within the blade carrying body that fail upon impact, resulting in non-penetration of the arrow. With such relatively complex mechanisms, dirt or other materials that may enter such conventional arrowheads can affect the reliability of the arrowhead, particularly after prolonged use. Examples of such mechanisms are disclosed in U.S. Pat. Nos. 5,112,063, 4,998,738 and 5,082,292. The deployable cutting blades are connected by pivot features to a plunger. The cutting blades pivot between an open cutting position and a closed non-barbed position. U.S. Pat. No. 5,102,147 discloses a ballistic broadhead assembly that has blades pivotally mounted on an actuating plunger. Upon impact, the actuating plunger thrusts the blades outwardly and forwardly.

Other conventional broadheads which have blades partially hidden within the body use annular retaining rings, such as O-rings, wraps, bands and the like, in order to maintain the blades in a closed position during flight. Upon impact, such annular retaining rings are designed to sheer or roll back along the opening blades, in order to allow the blades to move to an open position. Quite often, such conventional annular retaining rings are prone to cracking, particularly when the elastomer material dries out. Upon release of a bowstring, the rapid acceleration and thus significant opening forces move the blades in an opening direction. The conventional annular retaining rings counteract such opening forces. However, when the ring material dries out, cracks or is otherwise damaged, the blades may open prematurely, resulting in significant danger or injury to the archer.

Many of the annular retaining rings are designed for one use and thus must be replaced after each use. In addition to the cost involved with supplying such consumable item, the annular retaining rings are difficult and time-consuming to install, such as when hunting, particularly during inclement weather. Furthermore, the material properties of such conventional annular retaining rings can be affected by temperature changes, thereby resulting in different bias forces that cause the blade to open prematurely or to not open when desired.

One class of mechanical broadheads deploy the blades in an over-the-top motion, such as disclosed in U.S. Pat. No. 5,090,709. The extendable blades are pivotally connected to a body near the rear of the broadhead body. A ring releasably holds the extendable blades within corresponding slots within the body.

High-speed photography of over-the-top broadheads shows that the blades often do not fully open until after the blades enter the target. Consequently, the full cutting diameter of an over-the-top broadhead is often not available through the depth of the target. Also, as illustrated in FIG. 1, an angled hit with over-the-top broadhead 20 can also result in one of the blades 22A engaging the target 24 before the other blade 22B, potentially applying a deflection force 26 on the broadhead 20. Both the deflection force 26 and blade deployment 22A, 22B during entry of the over-the-top broadhead 20 can dramatically reduce kinetic energy of the arrow.

BRIEF SUMMARY OF THE INVENTION

The present invention is directed to an improved expandable broadhead with rear deploying blades. The rear deploying blades deploy reliably upon impact of the blades with the target. The present expandable broadhead resists deflection by the target regardless of the angle of entry. Consequently, the present expandable broadhead maximizes kinetic energy on impact and increases the probability of substantial penetration into the target.

DETAILED DESCRIPTION OF THE INVENTION

Figure 2:
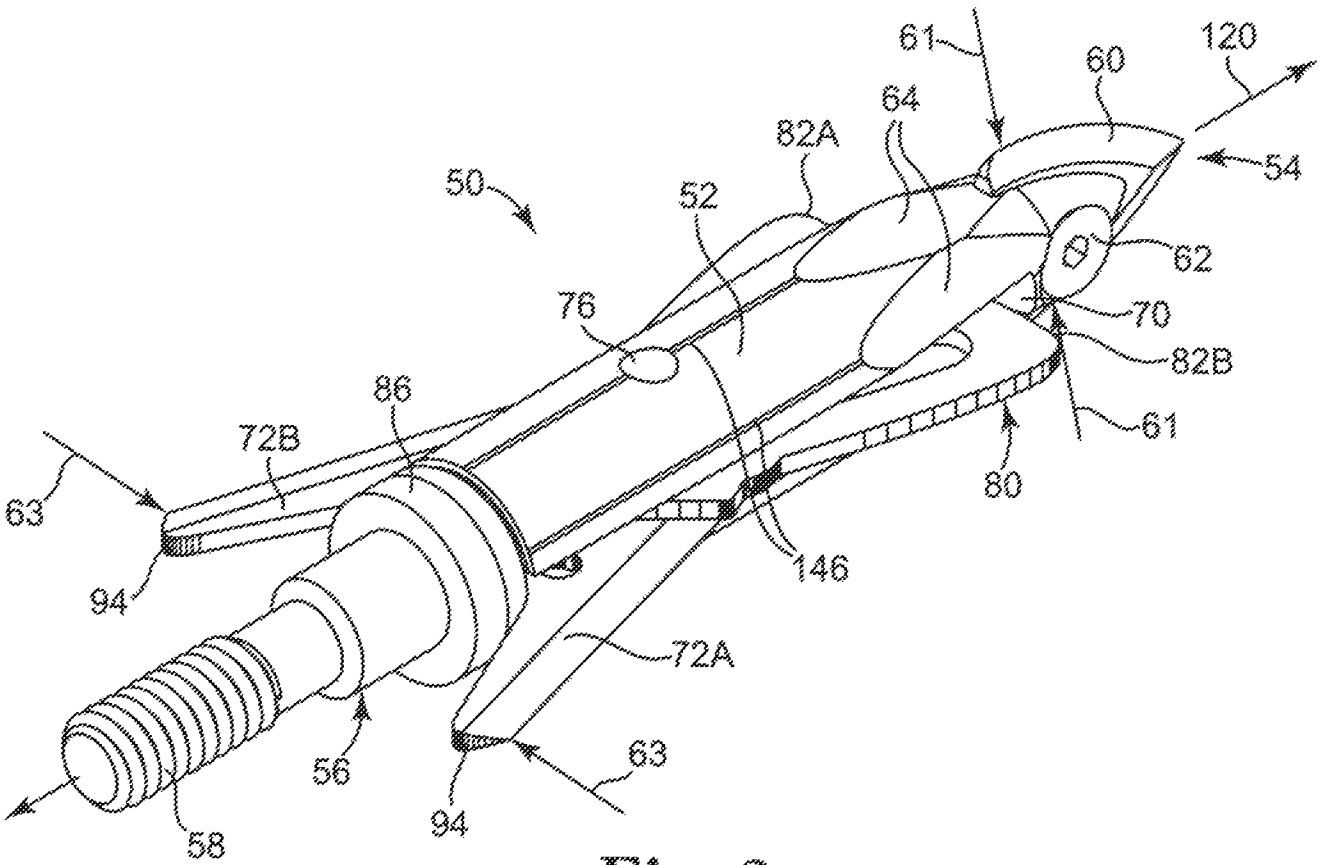
FIG. 2 is a perspective view of a two-blade expandable broadhead in a retracted configuration in accordance with an embodiment of the present invention.

FIG. 2 is a perspective view of an expandable broadhead 50 in accordance with an embodiment of the present invention. The expandable broadhead 50 includes a broadhead body 52 with a penetrating end 54 and a rear end 56.

The rear end 56 preferably includes threads 58 that couple with a conventional arrow shaft. In the illustrated embodiment, the penetrating end 54 includes a tip blade 60 attached to the broadhead body 52 by fastener 62. The illustrated fastener 62 is adapted to receive a hex-shaped tool, that can optionally be provided to permit easy replacement of the tip blade 60, such as for example the tools disclosed in U.S. Pat. No. 6,684,741, which is hereby incorporated by reference.

In an alternate embodiment, the penetrating end may take a variety of other forms, such as for example conical, faceted, or a straight tapered structure, with or without the tip blade 60. In another embodiment, the penetrating end 54 is formed with the broadhead body 52 as a unitary structure.

The penetrating end 54 of the broadhead body 52 preferably includes a plurality of facets or flat regions 64. In the illustrated embodiment, the broadhead body 52 includes six facets 64. It is believed that the facets 64 increase the aerodynamic stability of the expandable broadhead 50 during flight. The number of facets 64 can vary with broadhead design and other factors.

The broadhead body 52 includes one or more slots 70 adapted to receive one or more rear deploying blades 72A, 72B (referred to collectively as "72"). The rear deploying blades of the present invention can also be referred to generically as cutting blades, as distinguished from a tip blade. In the illustrated embodiment, a single slot 70 receives both of the rear deploying blades 72. The rear deploying blades 72 are slidably engaged with the broadhead body 52. In the preferred embodiment, the blades 72 are pivotally attached to the broadhead body 52 by pivot feature 76, such as the pin illustrated in FIG. 4. The pivot feature 76 is preferably a threaded fastener, such as the hex fastener 62 illustrated in FIG. 2 that can be removed to permit blade replacement. A hex-shaped tool or other tool suitable for removing the pivot feature 76 is preferably provided with the present expandable broadheads to permit easy blade replacement.

As used herein, "rear deploying" means rearward translation of blades generally along a longitudinal axis of a broadhead body and outward movement of a rear portion of the blade way from the longitudinal axis. The rearward translation can be linear, curvilinear, rotational or a combination thereof.

In a rear deploying system the rear portion of the blade typically remains on the same side of a blade pivot axis in both the retracted and deployed configurations. An example of the movement of a rear deploying blade is illustrated in FIGS. 7A-7F. Prior expandable broadheads with rear deploying blades are disclosed in U.S. Pat. No. 6,517,454 (Barrie et al.); U.S. Pat. No. 6,626,776 (Barrie et al.); and U.S. Pat. No. 6,910,979 (Barrie et al.), which are hereby incorporated by reference.

In the embodiment of FIG. 2, the blades 72 are generally parallel to longitudinal axis 120. In an alternate embodiment, the blades 72 may be offset or oriented a slight angle with respect to the longitudinal axis, causing rotation of the broadhead 50 during flight, such as disclosed in U.S. patent Ser. No. 11/037,413 entitled Broadhead with Reversible Offset Blades, which is hereby incorporated by reference.

The tip blade 60 has maximum width 61, which is typically less than maximum width 63 of the blades 72 in the retracted configuration 80. In one embodiment, the maximum width 61 is greater than the maximum width 63. In the illustrated embodiment, the maximum width 63 of the blades 72 is near the rear portion 94, but may be in other locations, such as for example near the penetrating edges 82.

FIG. 2 illustrates the expandable broadhead 50 with the rear deploying blades 72 in the retracted configuration 80. In the retracted configuration 80, impact edges 82A, 82B (referred to collectively as "82") of the rear deploying blades 72A, 72B, respectively, are positioned exterior to the broadhead body 52. As will be discussed in greater detail below, retainer 86 assists in retaining the rear deploying blades 72 in the retracted configuration 80.

In one embodiment, the broadhead body 52 optionally includes one or more elongated features 146. The elongated features 146 can be either concave, convex, or a combination thereof. In one embodiment, the features 146 are grooves or depressions arranged generally parallel to the longitudinal axis 120. In another embodiment, the features 150 are ridges or protrusions. The features 146 are believed to provide a number of functions, such as aerodynamics, stability of the expandable broadhead 50 as it penetrates a target, and the release of fluid pressure that may accumulate in front of the expandable broadhead 50. As will be illustrated in FIGS. 4-6, the blades 72 may optionally include elongated features as well.

Figure 3:
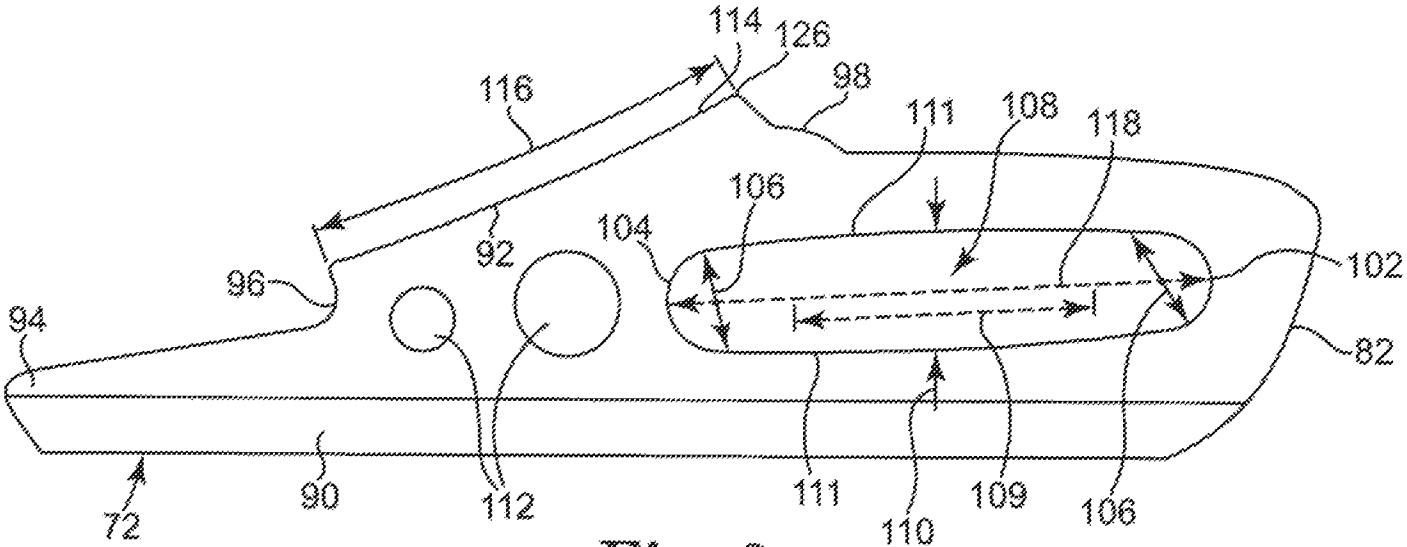
FIG. 3 is a side view of a rear deploying blade illustrated in FIG. 2.

FIG. 3 is a side view of one embodiment of the rear deploying blades 72 in accordance with an embodiment of the present invention. In the illustrated embodiment, the rear deploying blades 72 are same. In an alternate embodiment, the blades 72 may have different configurations, such as to have asymmetrical deployment profiles.

The rear deploying blades 72 of FIG. 3 include the impact edge 82, a cutting edge 90, a camming edge 92, and a rear portion 94. Notch 96 is preferably located between the camming edge 92 and the rear portion 94. Camming edge 92 includes a transition region 126 adjacent to a deployment region 98. In the illustrated embodiment, the transition region 126 is a step or drop-off to a deployment region 98. The deployment region 98 optionally includes a protrusion. Alternatively, the deployment region 98 can include a recess, such as for example a recess shaped to couple with the retainer 86.

In the illustrated embodiment, the rear deploying blades 72 include slot 100 that extends proximate the impact edge 82 towards the camming edge 92. The slot 100 includes first end 102, a center portion 108, and second end 104. In the embodiment illustrated in FIG. 3, the first and second ends 102, 104 have a diameter 106 (or shape) that corresponds closely to the diameter (or shape) of the pivot feature 76. It will be appreciated that a recess could be substituted for slot 100 and that the term "slot" is used generically herein to include a cut-out through extending completely through the blade, a single recess on one side of the blades or recesses on both sides of the blades.

Center portion 108 of the slot 100 preferably has a width 110 greater than the diameter 106, and hence, the width 110 is greater than the maximum diameter of the pivot feature 76. The width 110 preferably defines a free floating region 109 that the pivot feature 76 can theoretically traverse without contacting sidewalls 111 of the slot 100. The free floating region 109 minimizes friction and deflection forces during deployment of the blades 72. As used herein, "free floating region" refers to a portion of a slot/pivot feature interface in which the gap between the pivot feature and side walls of the slot is greater than the gap between the pivot feature and at least one end of the slot. In the embodiments in which the pivot feature has a non-circular cross-section, the maximum cross-sectional dimension of the pivot feature is substituted for diameter.

The rear deploying blades 72 of FIG. 3 optionally include one or more cutouts 112. The cutouts 112 optionally serve to reduce the weight of the blades 72, to increase the strength and/or flexibility of the blades 72, or a variety of other functions.

In the illustrated embodiment, the camming edge 92 has a slightly concave curvature 114 and length 116. Alternate camming edge configurations are discussed below. The length 116 of the camming edge 92 is corresponds to length 118 of slot 100. In one embodiment, the length 116 of the camming edge 92 plus the diameter of the pivot feature 76 is approximately equal to the length 118 of the slot 100. Alternatively, the travel distance of the pivot feature 76 in the slot 100 is approximately equal to the length of the camming edge 92.

In the preferred embodiment, during blade deployment the retainer 86 reaches the transition region 126 just before the pivot feature 76 engages the first end 102 of the slot 100. The retainer passes the transition region 126 and enters the deployment region 98 when the pivot feature 76 engages the first end 102 of the slot 100. This configuration releasably secured in the blade 72 in the deployed configuration 130 by simultaneous engagement of the pivot feature 76 with the first end 102 of the slot 100 and the engagement of the deployment region 98 with the retainer 86.

As will be discussed in detail below, the shape of the curvature 114 and the shape of the slot 100 determine the rate and angle at which the blades 72 move from the retracted configuration 80 to the deployed configuration 130. Consequently, the shape of the slot 100 and the camming edge 92 can be engineered to create a variety of deployment profiles. As used herein, "deployment profile" refers to the path traversed by a blade from a retracted configuration to a deployed configuration.

Figure 4A:
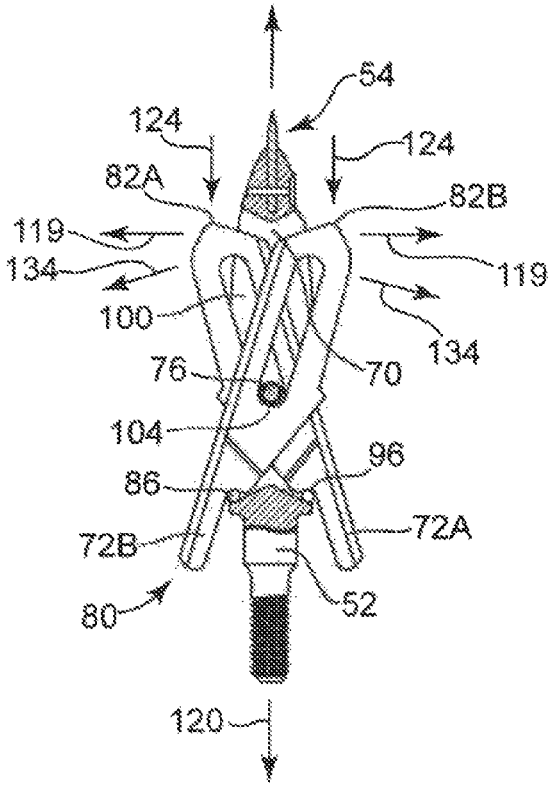
FIG. 4A is a side sectional view of the two-blade expandable broadhead of FIG. 2 in a retracted configuration in accordance with an embodiment of the present invention.

FIG. 4A is a cross-sectional view of the expandable broadhead 50 in the retracted configuration 80. Rear deploying blades 72 are partially retained in slot 70. The pivot feature 76 is positioned in the second ends 104 of the slots 100. The pivot feature 76 has a diameter corresponding generally to the diameters of the second ends 104, limiting lateral movement of the blades 72 along the axes 119. The notches 96 are coupled to retainer 86, thus retaining the blades 72 close to the longitudinal axis 120. The combination of the pivot feature 76 engaged with the second ends 104 and the notches 96 engaged with the retainer 86 secure the blades 72 in the retracted configuration 80.

Upon impact, the penetrating end 54 proceeds into the object. As the retractable broadhead 50 advances into the object, the impact edges 82 also contact the object. Because the impact edges 82 extend beyond the perimeter of the broadhead body 52, movement of the expandable broadhead 50 into the object causes generally oppositely directed forces 124 to act on the impact edges 82.

In the illustrated embodiment, the impact edges 82 are angled slightly backward relative to axis 119 perpendicular to longitudinal axis 120. Consequently, forces 124 applied to the impact edges 82 generate torque 134 on the blades 72 that assists in releasing the notches 96 from the retainer 86. In an alternate embodiment, the impact edges 82 extend perpendicular to the longitudinal axis 120. The forces 124 acting on the impact edges 82 at a distance from the longitudinal axis 120 is sufficient to deploy the blades 72.

Figure 4B:
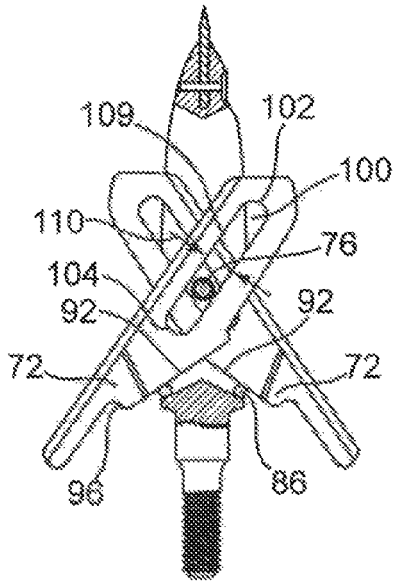
FIG. 4B is a side sectional view of the two-blade expandable broadhead of FIG. 2 in a partially deployed configuration in accordance with an embodiment of the present invention.

As best illustrated in FIG. 4B, once the notches 96 are released from the retainer 86, the caroming edges 92 ride along the retainer 86 towards the deployed configuration. Since the widths 110 of the slots 100 in the center region 108 between the first and second ends 102, 104 are greater than the diameter of the pivot feature 76, the blades 72 move relatively freely in the free floating region 109.

Figure 4C:
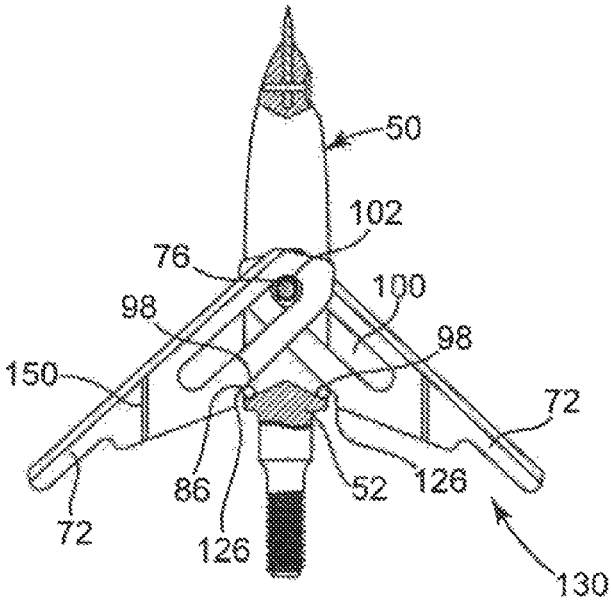
FIG. 4C is a side sectional view of the two-blade expandable broadhead of FIG. 2 in a deployed configuration in accordance with an embodiment of the present invention.

FIG. 4C is a sectional view of the expandable broadhead 50 in the deployed configuration 130 in accordance with an embodiment of the present invention. The first ends 102 of the slots 100 are engaged with the pivot feature 76. The transition regions 126 on the blades 72 have moved past the retainer 86, retaining the blades 72 in the deployed configuration 130. The tight tolerances between the second ends 102 and the pivot feature 76 aids in stabilizing the position of the rear deploying blades 72 and provide more uniform force distribution between the pivot feature 76 and the second ends 102. As a result, blade failure on deployment is reduced.

The retainer 86 is positioned in between the deployment regions 98 located along the rear edges of the blades 72 and the broadhead body 52. In the preferred embodiment, the retainer 86 is a resilient or elastomeric material that absorbs some of the impact force between the blades 72 and the broadhead body 52 in the deployed configuration 130 illustrated in FIG. 6. The shock absorbing properties of the retainer 86 reduces blade failure in the deployed configuration 130. In another embodiment, the retainer 86 plastically deforms upon impact of the blades 72.

The retainer 86, broadhead body 52 and blades 72 can be made from a variety of materials, such as polymeric materials, metals, ceramics, and composites thereof. The Durometer of the retainer 86 can be selected based on the degree of impact absorption required, the configuration of the blades 72, and the like. For example, the retainer 86 can be constructed as a metal snap ring made from a softer metal than the blades 72. In another embodiment, the retainer 86 is constructed from a low surface friction material, such as for example nylon, to facilitate blade deployment.

The blades 72 of FIGS. 4A-4C optionally include one or more elongated features 150. The elongated features 150 can be either concave, convex, or a combination thereof. In one embodiment, the elongated features 150 are grooves or depressions arranged generally parallel to the longitudinal axis 120 when the blades 72 are in the deployed configuration 130. In another embodiment, the elongated features 150 are ridges or protrusions. The elongated features 150 are believed to serve a number of functions, such as facilitating deployment of the blades 72, stability of the expandable broadhead 50 as it penetrates a target, and the release of fluid pressure that may accumulate in front of the expandable broadhead 50.

Figure 5A:
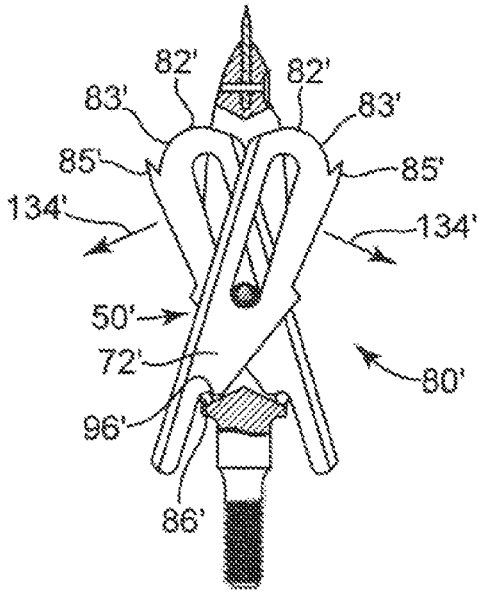
FIG. 5A is a side sectional view of an alternate expandable broadhead with engagement features on blades in accordance with an embodiment of the present invention.

FIG. 5A is a cross-sectional view of an alternate expandable broadhead 50' in the retracted configuration 80'. The impact edges 82' have curved profiles 83' to provide a more aerodynamic profile. Protrusions 85' are located at the base of the curved profiles 83' to engage with the target and promote blade deployment. The location of the protrusions 85' generate increased torque 134' on the blades 72' that assists in releasing the notch 96' from the retainer 86'. The blades 72' of FIG. 5A are particularly well suited for use with retainers 86' made of metal or other stiff materials.

Figure 5B:
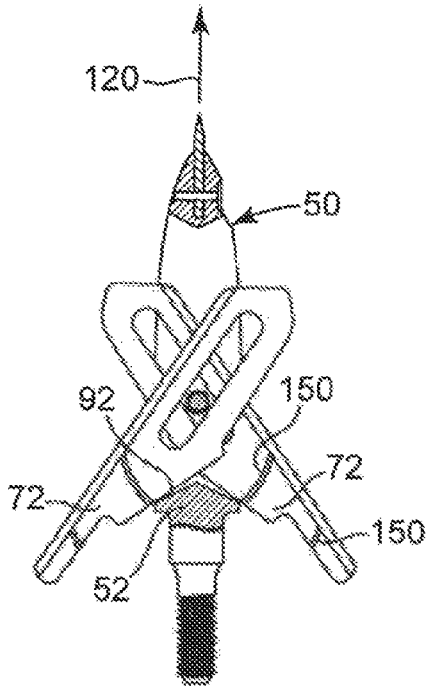
FIG. 5B is a side sectional view of an alternate expandable broadhead with blades contacting a broadhead body in a deployed configuration in accordance with an embodiment of the present invention.

FIG. 5B illustrates another alternate embodiment of a expandable broadhead 50 where the camming edges 92 ride on the broadhead body 52 rather than the retainer 86 (see e.g., FIG. 4B). The retainer 86 is preferably positioned closer to the longitudinal axis 120 so as to not engage the blades 72 during deployment. In the embodiment of FIG. 5B, the retainer 76 may still absorb impact between the blades 72 and the broadhead body 52 at the deployed configuration 130. For purposes of the present invention, the blades may ride or slide on either the broadhead body or the retainer and the disclosed embodiments should be interpreted to have either configuration.

The blades 72 of FIG. 5A optionally include one or more curved elongated features 150. The curved elongated features 150 can be either concave or convex. The curved shape of the features 150 is particularly well suited to facilitate deployment of the blades 72. In the preferred embodiment, the shape of the elongated features corresponds generally to the deployment profile of the blades 72.

Figure 6B:
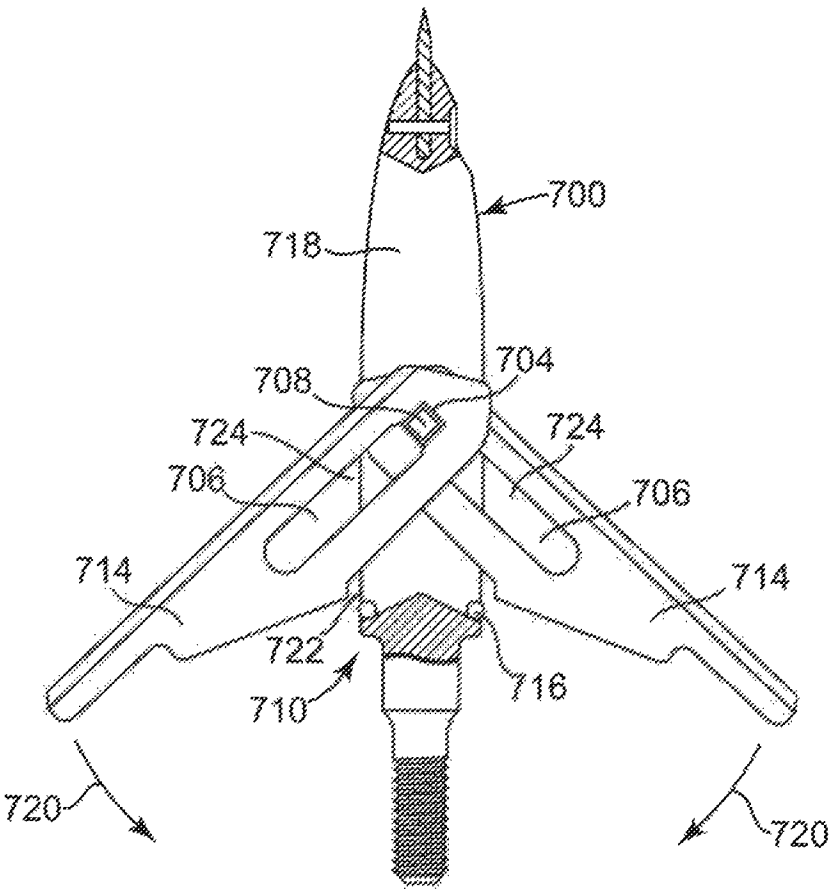
FIG. 6B is a side sectional view of the expandable broadhead of FIG. 6A in the deployed configuration.
Figure 6A:
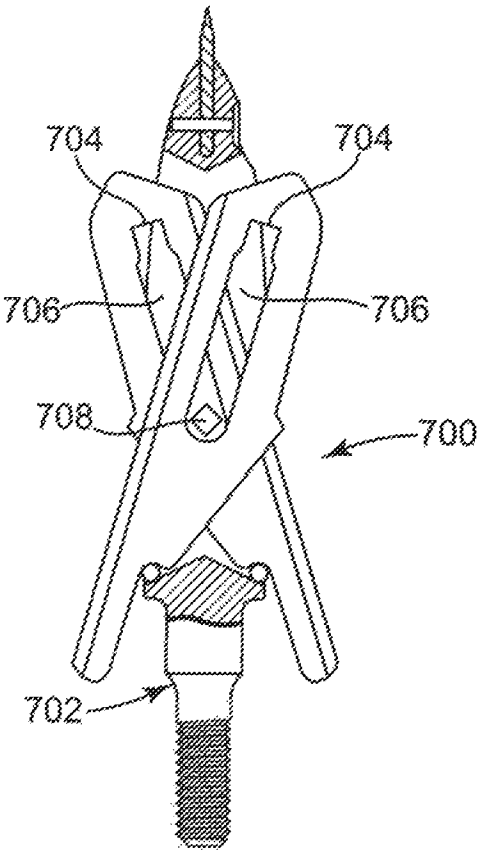
FIG. 6A is a side sectional view of an expandable broadhead with a non-cylindrical pivot feature in a retracted configuration in accordance with an embodiment of the present invention.

FIG. 6A is a sectional view of an alternate expandable broadhead 700 in the retracted configuration 702 in accordance with an embodiment of the present invention. First ends 704 of slots 706 are non-cylindrical. In the illustrated embodiment, the non-cylindrical first ends 704 are square, but could be triangular, rectangular, hexagonal, an irregular shape, or a variety of other non-cylindrical shapes. The pivot feature 708 is also non-cylindrical. In the illustrated embodiment, the pivot feature 708 has a square cross-section with a diagonal dimension that is less than the width of the slot 706 providing a free floating region 724. The free floating region 724 permits the blades 714 to rotate freely during movement from the retracted configuration 702 to the deployed configuration 710. (See FIG. 6B.) As used herein, the term "pivot feature" is not limited to a particular cross-sectional shape.

FIG. 6B is a sectional view of the expandable broadhead 700 of FIG. 6A in the deployed configuration 710. The first ends 704 of the slots 706 are engaged with the non-cylindrical pivot feature 708 in the deployed configuration 710. The tight tolerances between the first end 704 and the pivot feature 708 provide more uniform force distribution between the pivot feature 708 and the first end 704.

In the illustrated embodiment, the non-cylindrical pivot feature 708 holds the blades 714 in the deployed configuration 710 without direct contact with the retainer 716 or the broadhead body 718. The deployed configuration 710 includes gap 722 between the blades 714 and the retainer 716. The cantilevered configuration illustrated in FIG. 6B permits the blades 714 to flex in directions 720. In one embodiment, the blades 714 flex into and out of contact with the retainer 716.

In another embodiment of the broadhead 700, blades 714 engage with retainer 716 in the deployed configuration 710, such as illustrated in FIG. 6. The retainer 716 preferably operates as a shock absorber.

Figure 7A:
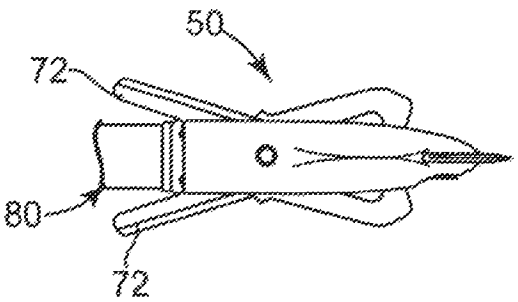
FIGS. 7A-7F illustrate a sequence of blade movement from a retracted configuration to an expanded configuration in an expandable broadhead in accordance with an embodiment of the present invention.
Figure 7B:
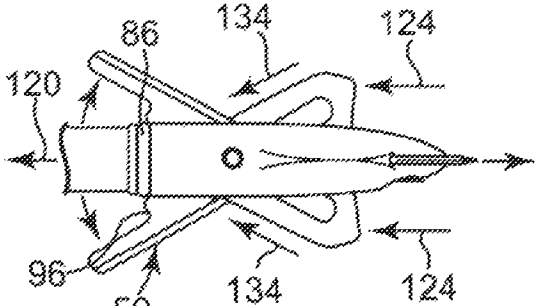
Figure 7C:
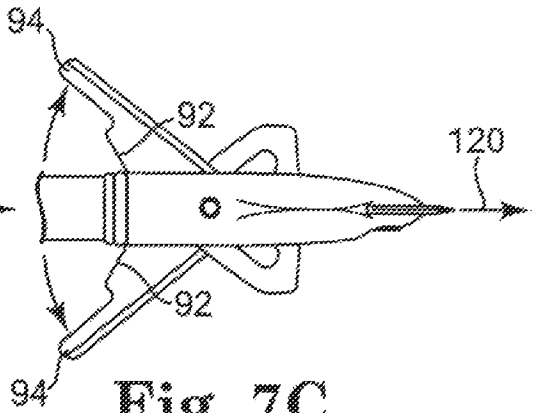
Figure 7D:
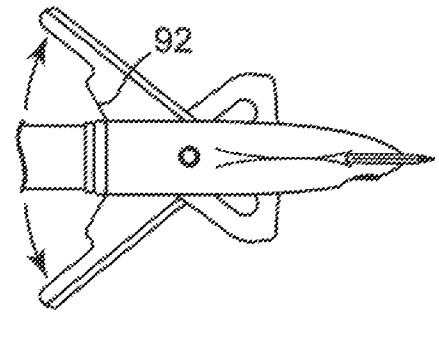
Figure 7E:
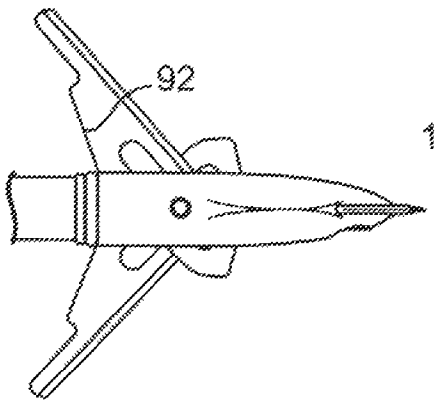
Figure 7F:
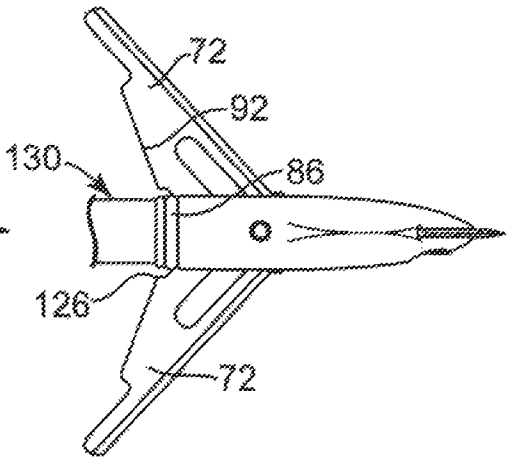

FIGS. 7A through 7F illustrate the expandable broadhead 50 as the blades 72 move between the retracted configuration 80 illustrated in FIG. 7A and the deployed configuration 130 illustrated in FIG. 7F. FIG. 7B illustrates the forces 124 acting on the expandable broadhead 50 upon impact with an object. In the illustrated embodiment, the forces 124 acting on the impact edges 82 at a distance from the longitudinal axis 120 generates torque 134 that causes the blades 72 to rotate slightly, thereby releasing the notches 96 from the retainer 86.

FIGS. 7C through 7E illustrate further rearward movement of the blades 72 along the longitudinal axis 120. As the blades 72 continue to move toward the rear of the expandable broadhead 50, the rear ends 94 of the blades move away from the longitudinal axis 120. As the blades 72 move rearward, the camming edges 92 force the rear ends 94 of the blades 72 further away from the longitudinal axis. As illustrated in FIG. 7F, the transition regions 126 on the blades 72 have moved past the retainer 86 to assist in maintaining the blades 72 in the deployed configuration 130.

Figure 1:
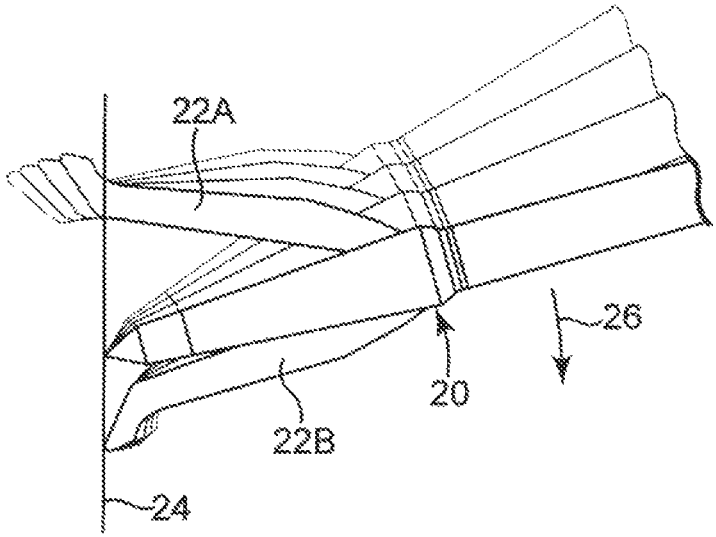
Fig. 1 PRIOR ART
FIG. 1 is a schematic illustration of a prior art over-the-top expandable broadhead impacting a target.
Figure 8:
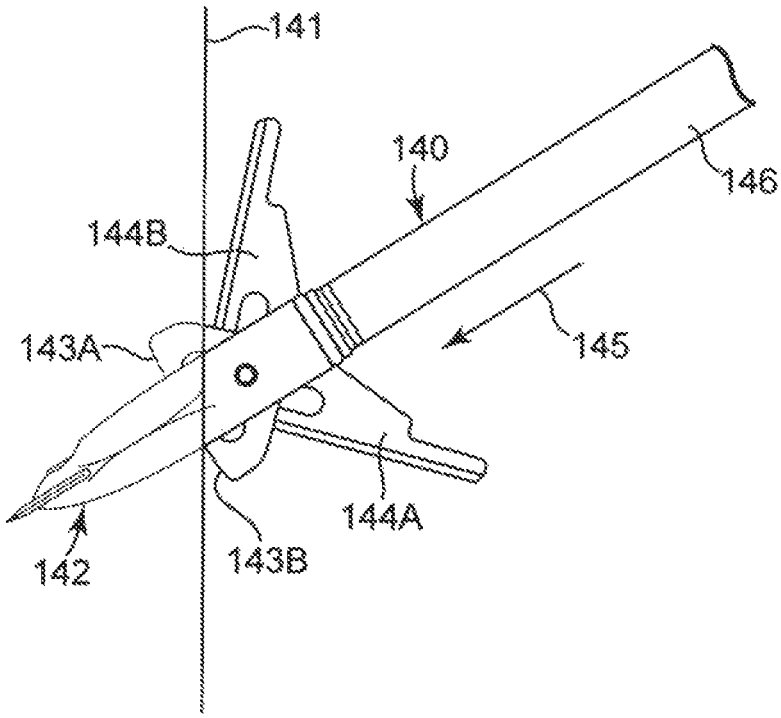
FIG. 8 is a side view of an expandable broadhead penetrating an object in accordance with an embodiment of the present invention.

FIG. 8 is a schematic illustration of the expandable broadhead 140 in accordance with an embodiment of the present invention penetrating object 141. The penetrating end 142 makes contact with the object 141 before the impact edges 143A, 143B of the blades 144A, 144B, respectively. Consequently, the penetrating end 142 acts to secure the expandable broadhead 140 to the object 141 sufficiently to resist any lateral forces, such as when the impact edge 143A contacts the object 140 before the impact edge 143B. Therefore, impact with the object 141 causes minimal or no deflection of the expandable broadhead 140 from its original trajectory 145. This straight-line motion along trajectory 145 maximizes the kinetic energy of the arrow 146 into and through the object 141.

Figure 9:
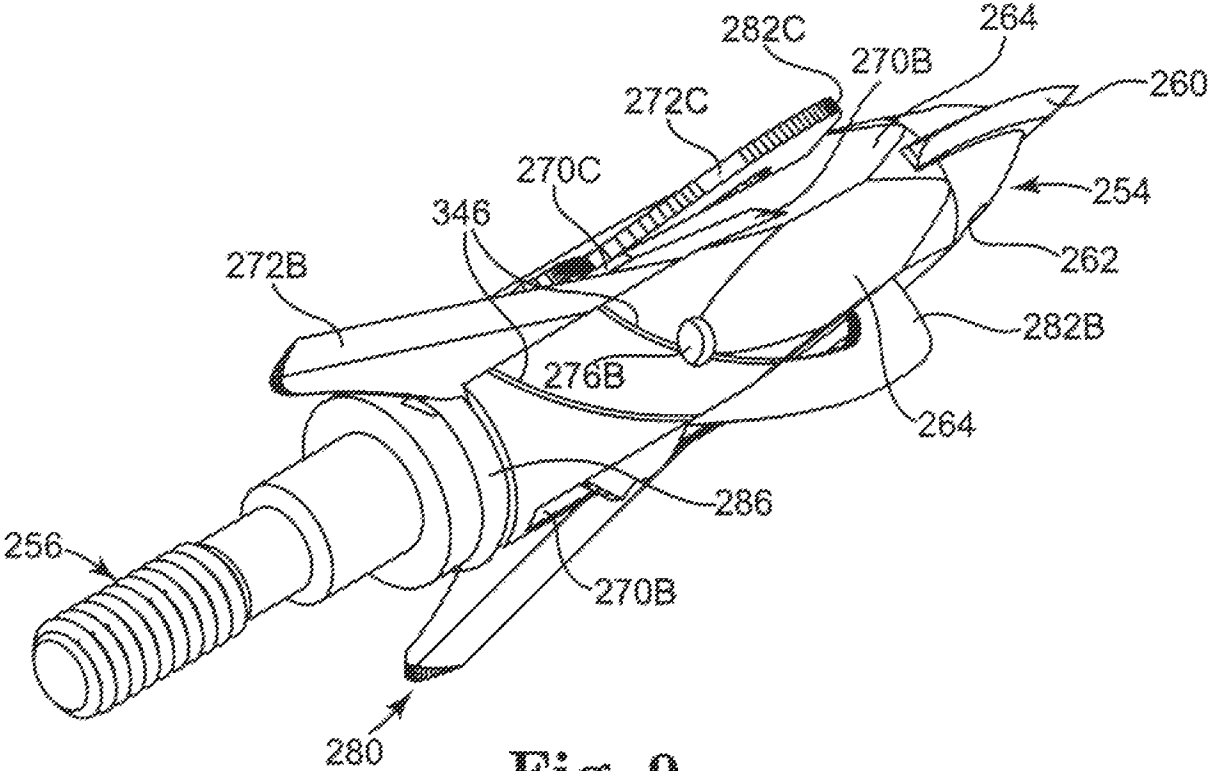
FIG. 9 is a perspective view of a three-blade expandable broadhead in a retracted configuration in accordance with an embodiment of the present invention.
Figure 10:
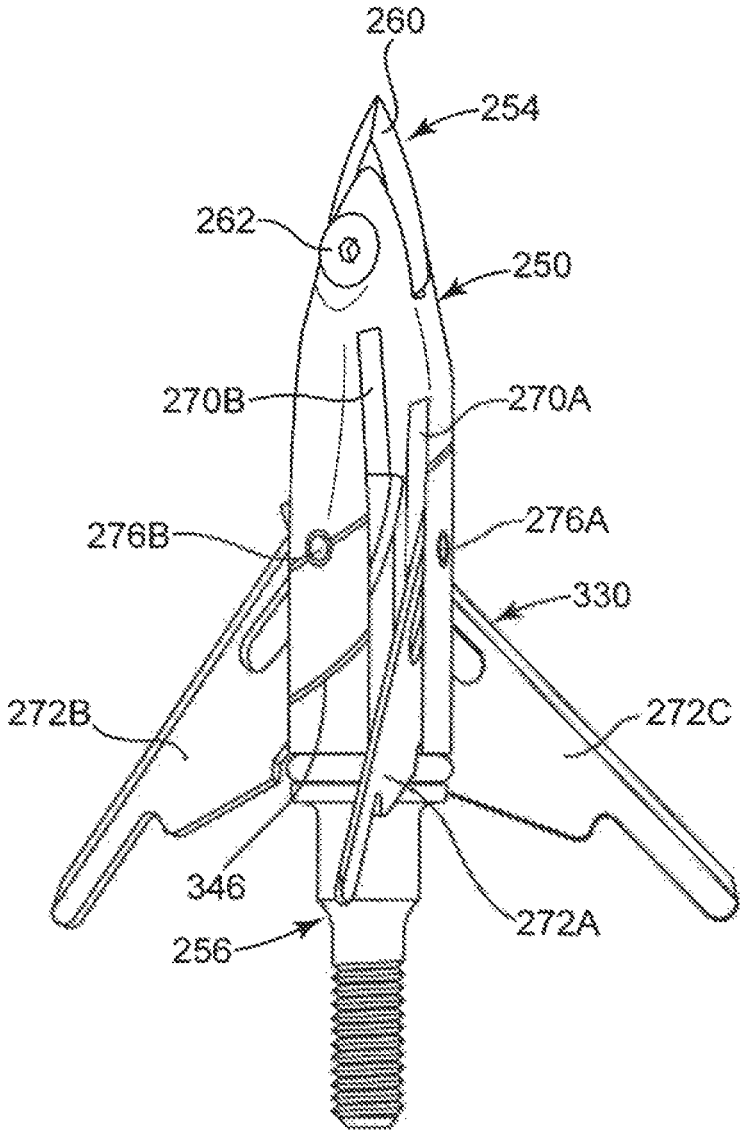
FIG. 10 is a perspective view of the expandable broadhead of FIG. 9 in a deployed configuration.

FIG. 9 is perspective views of a three-blade expandable broadhead 250 in retracted configuration 280 in accordance with an embodiment of the present invention. FIG. 10 illustrates the expandable broadhead 250 with the rear deploying blades 272 in the deployed configuration 330. As discussed above, the expandable broadhead 250 includes a broadhead body 252 with a penetrating end 254 and a rear end 256. While the penetrating end 254 includes a tip blade 260 attached to the broadhead body 252 by fastener 262, the penetrating end 254 may take a variety of other forms. The broadhead body 252 preferably includes a plurality of facets or flat regions 264 that increase the aerodynamic stability of the expandable broadhead 250 during flight.

The broadhead body 252 of FIGS. 9 and 10 include three slots 270A, 270B, 270C (referred to collectively as "270") adapted to receive one or more rear deploying blades 272A, 272B, 272C (referred to collectively as "272"). Each of the rear deploying blades 272 are slidably attached to the broadhead body 52 by separate pivot features 276A, 276B, 276C.

In the retracted configuration 280, impact edges 282A, 282B, 282C (referred to collectively as "282") of the rear deploying blades 272, respectively, are positioned exterior to the broadhead body 252. Retainer 286 assisted retaining the rear deploying blades 272 in the retracted configuration 280.

In the illustrated embodiment, broadhead body 252 optionally includes elongated features 346 arranged in a helix or coil configuration around the broadhead body 52. The elongated features 346 can be either concave, convex, or a combination thereof.

Figure 11:
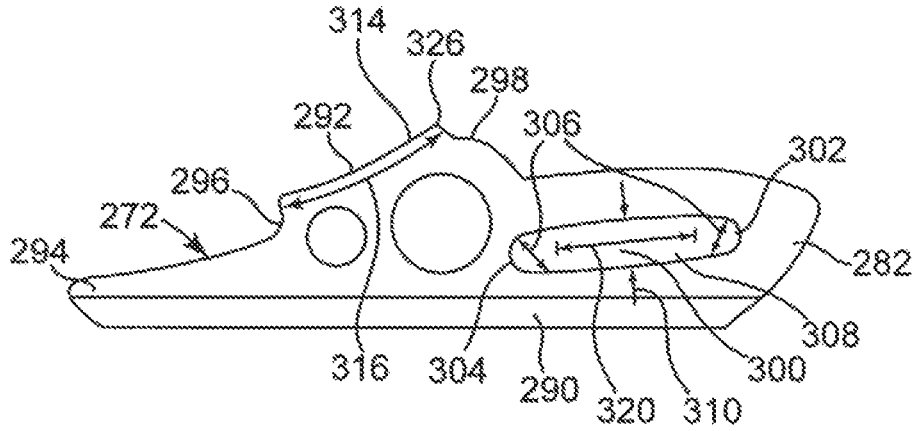
FIG. 11 is a side view of a rear deploying blade illustrated in FIG. 9.

FIG. 11 is a side view of the rear deploying blades 272 illustrated in FIGS. 9 and 10. In the illustrated embodiment, the rear deploying blades 272 may have the same or different configurations. The rear deploying blades 272 include the impact edge 282, a cutting edge 290, a camming edge 292, and a rear portion 294. Notch 296 is preferably located between the camming edge 292 and the rear portion 294. Transition region 326 is located at the end of the camming edge 292. Deployment region 298 is located between the transition region 326 and the impact edge 282.

In the illustrated embodiment, the rear deploying blades 272 include slot 300 that extends proximate the impact edge 282 towards the camming edge 292. The slot 300 includes first end 302, center portion 308, and second end 304. In the embodiment illustrated in FIG. 10, the first and second ends 302, 304 have a radius 306 that corresponds to the diameter of the pivot feature 276. The center portion 308 of the slot 300 has a width 310 greater than the diameter 306. The width 310 of the center portion 308 is preferably large enough to form a free floating region 320.

The camming edge 292 has a slightly concave curvature 314 and a length 316. The shape of the curvature 314 and the shape of the slot 300 determine the rate and angle at which the blades 272 move from the retracted configuration 280 to the deployed configuration 330. Alternate examples of camming edges are discussed below. In order to fit the three blades 272 in the broadhead body 252 without exceeding optimal weight, the blades 272 and the broadhead body 254 are typically shorter than the blades 72. The length 316 of the camming edge 292 is also shorter than the camming edge 116 illustrated in FIG. 3.

Deployment Profile

As discussed above, the shape of the slots of the camming edges can be modified to change the angle of blade deployment and the rate of blade deployment. FIGS. 12-18 relate to variations in the blades that permit different deployment profiles, preferably using the same broadhead body. It will be appreciated that the various features on the blades disclosed in FIGS. 12-18 can be combined with each other in a variety of other ways. Therefore, all of the possible permutations are not disclosed herein.

The various blade slots illustrated in FIGS. 12-18 preferably have first and second ends with diameters that correspond closely to the diameter or shape of the pivot features and a free floating region in between. In an alternate embodiment, the free floating region extends into one or both of the ends of the slots.

Generally, longer camming edges and corresponding longer slots result in a deployment profile where the blades more closely follows the longitudinal axis of the broadhead body before moving outward away from the longitudinal axis. Alternatively, shorter camming edges and shorter slots result in a deployment profile where the blades move outward away from the longitudinal axis more quickly. Expandable broadheads with longer slots are generally less likely to fail during deployment. Essentially infinite variation is possible.

Figure 12:
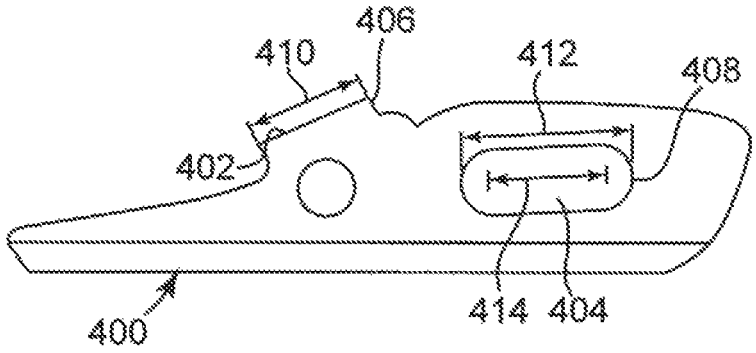
FIGS. 12-18 illustrate alternate blades for use in the present expandable broadhead with camming edges and slots that provide different deployment profiles in accordance with an embodiment of the present invention.

FIG. 12 illustrates an alternate blade 400 with a shortened camming edge 402 and a correspondingly shortened slot 404. The camming edge 402 is preferably sized so that the retainer or broadhead body (not shown) reaches transition region 406 just before the pivot feature (not shown) reaches the first end 408 of the slot 404. The slot 404 preferably includes a free floating region 414. By reducing length 410 of the camming edge and length 412 of the slot 404, the blade 400 deploys outward from the longitudinal axis (see FIG. 2) more quickly than a blade with a longer camming edge and slot. The blade 400 exhibits an accelerated deployment profile relative to the blade 272 in FIG. 11.

Figure 13:
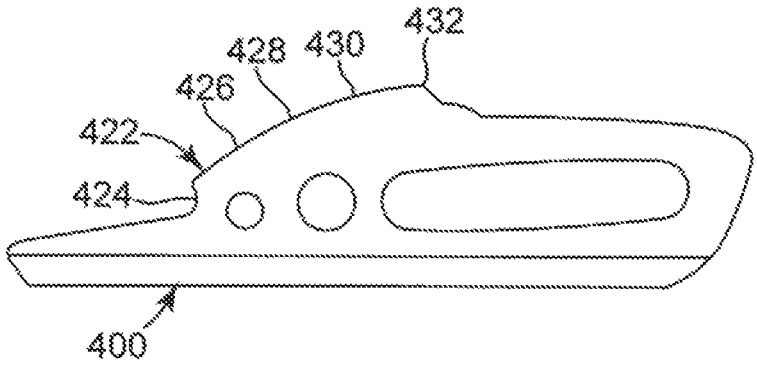

FIG. 13 illustrates an alternate blade 420 with a convex camming edge 422. The camming edge 422 initially contacts the broadhead body (not shown) adjacent to notch 424. The upward sloping portion 426 of the convex camming edge 422 from the notch 424 to the high point 428 results, in faster blade deployment than on the downward sloping portion 430 of the convex camming edge 422 from the high point 428 to the transition region 432. Consequently, the blade 420 exhibits an uneven deployment profile.

Figure 14:
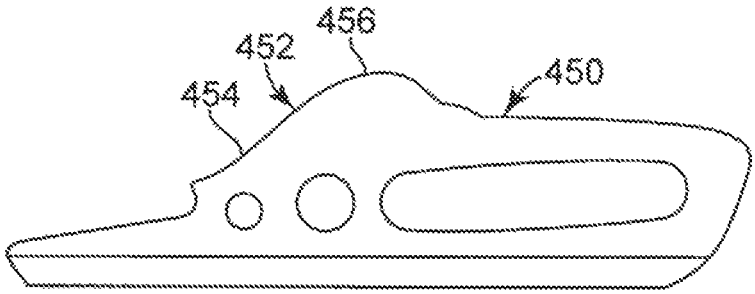

FIG. 14 illustrates an alternate blade 450 with a camming edge 452 having a concave first portion 454 and a convex second portion 456. Consequently, the blade 450 exhibits an irregular deployment profile.

Figure 15:
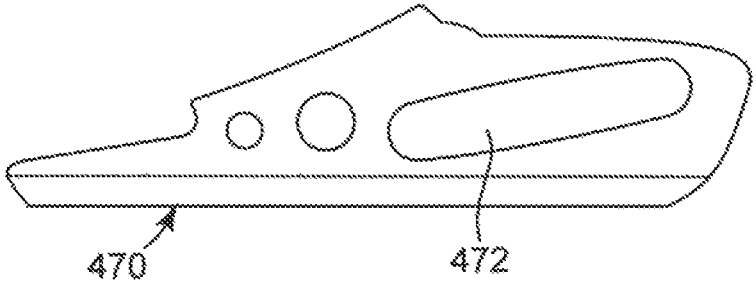
Figure 16:
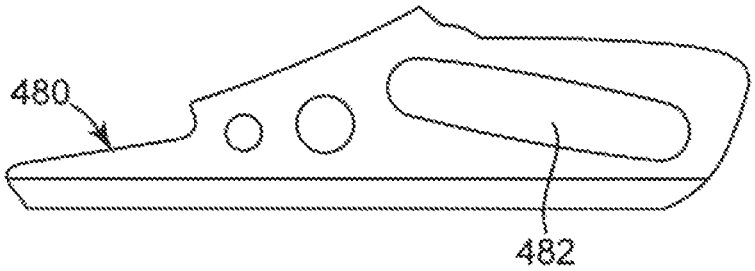
Figure 17:
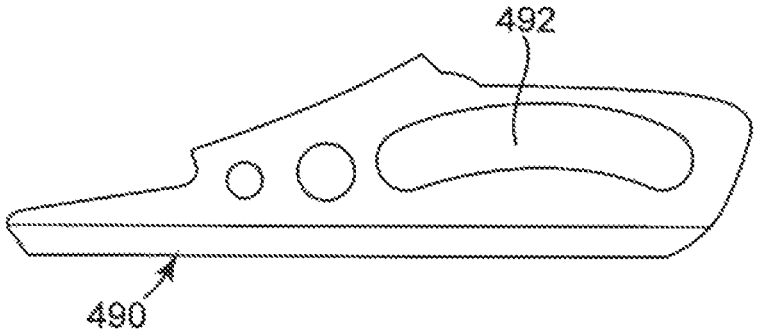
Figure 18:
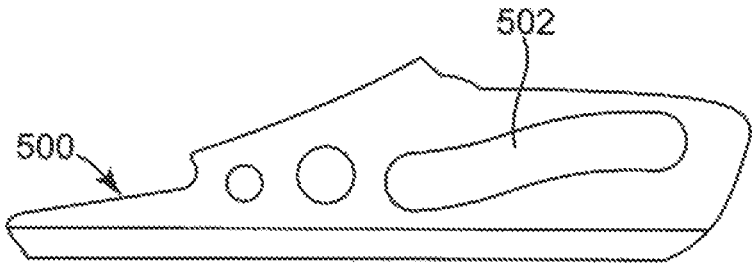

FIG. 15 illustrates an alternate blade 470 with an upwardly angled slot 472. FIG. 16 illustrates an alternate blade 480 with a downwardly angled slot 482. FIG. 17 illustrates an alternate blade 490 with an upwardly curved slot 492. FIG. 18 illustrates an alternate blade 500 with a slot 502 that is both angled and curved. Each of these blades will exhibit a different deployment profile.

Figure 19:
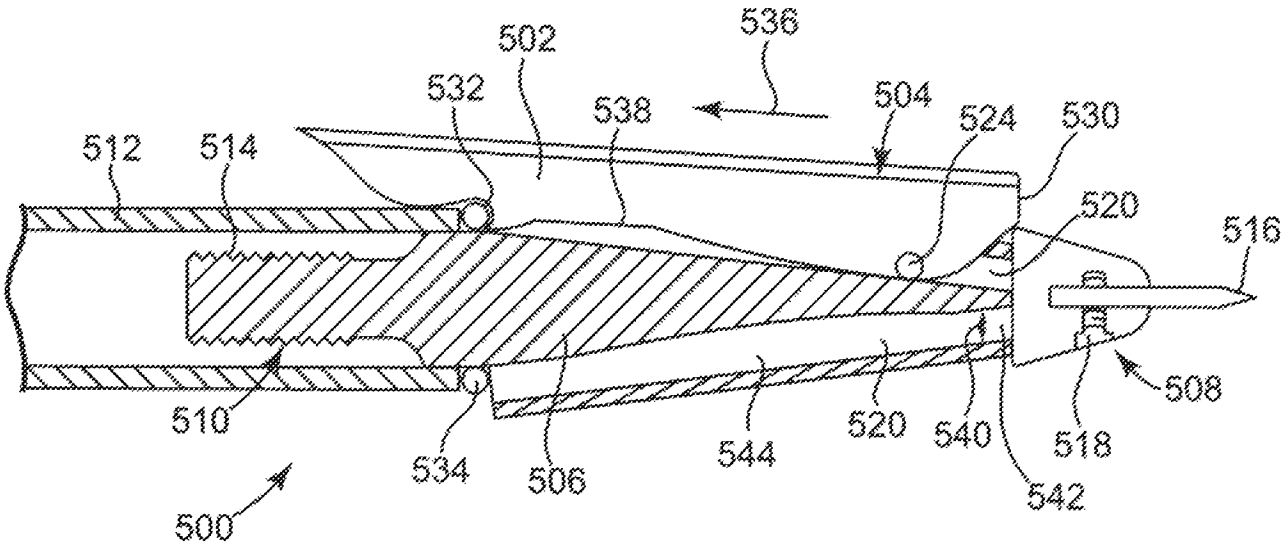
FIG. 19 illustrates an alternate expandable broadhead, in accordance with an embodiment of the present invention.

FIG. 19 illustrates the expandable broadhead 500 with the rear deploying blades 502 in the retracted configuration 504. The expandable broadhead 500 includes a broadhead body 506 with penetrating end 508 and rear end 510. The rear end 510 is coupled to arrow shaft 512 by threads 514. In the illustrated embodiment, the penetrating end 508 includes a tip blade 516 attached to the broadhead body 506 by fastener 518. The penetrating end 508 of the broadhead body 506 preferably includes a plurality of facets or flat regions (see e.g., FIG. 2).

The broadhead body 506 includes one or more generally T-shaped slots 520 adapted to receive the rear deploying blades 502. FIG. 19 illustrates one of the slots 520 without a blade 502 for illustration purposes only. The rear deploying blades 502 are slidably engaged with the generally T-shaped slot 520 by boss or protrusion 524. The protrusion 524 can be integrally formed with the blades 502 or a separate component attached to the blades 502. In one embodiment, the protrusion 524 has an elongated shape to limit rotation of the blades 502 during deployment. In this alternate embodiment, the deployment profile is determined primarily by the shape and angle of the slot 520. The general concept of a boss or protrusion on a blade that slidably engages with a slot in a broadhead body is discussed in U.S. Pat. No. 6,935,976 (Grace, Jr. et al.), which is hereby incorporated by reference.

In the retracted configuration 504, impact edge 530 is positioned exterior to the broadhead body 506. Notch 532 on the blade 522 is releasably coupled to retainer 534 to retain the rear deploying blade 522 in the retracted configuration 504. When the impact edge 530 contacts an object, the notch 532 releases from the retainer 534 and the blades 502 are displaced rearward generally in direction 536. As the blades 502 move rearward, camming edge 538 rides on the retainer 534, causing the blades 502 to move from the retracted configuration 504 to a deployed configuration.

The pivot feature 524 preferably has a diameter close to width 540 of the first end 542 of the slot 520. The slots 520 preferably include a free floating region 544. The second end 546 optionally includes the same width 540 as the first end 542.

The camming edge 538 and the location of the protrusion 524 can be changed to modify the deployment profile of the blade 502, as discussed herein. In the preferred embodiment, the retainer 534 is a resilient or elastomeric material that absorbs some of the impact force that occurs during deployment of the blades 502. The blades 502 are replaced by removing the broadhead body 506 from the arrow shaft 512, thereby exposing the second ends 546 of the slots 520.

Figure 27B:
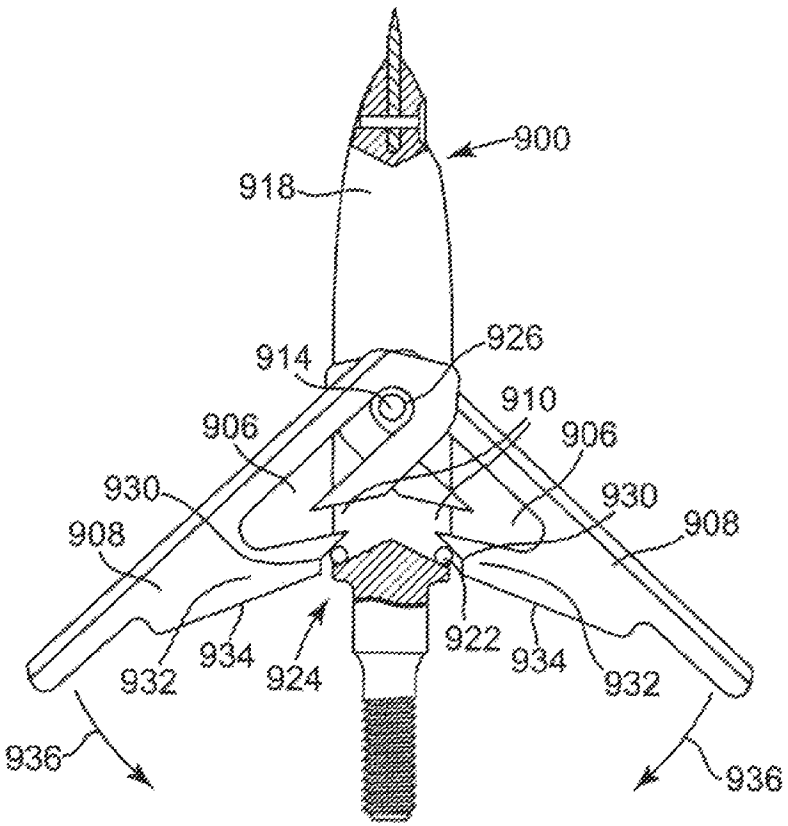
FIG. 27B is a side view of the expandable broadhead of FIG. 27A in the deployed configuration in accordance with an embodiment of the present invention.
Figure 27A:
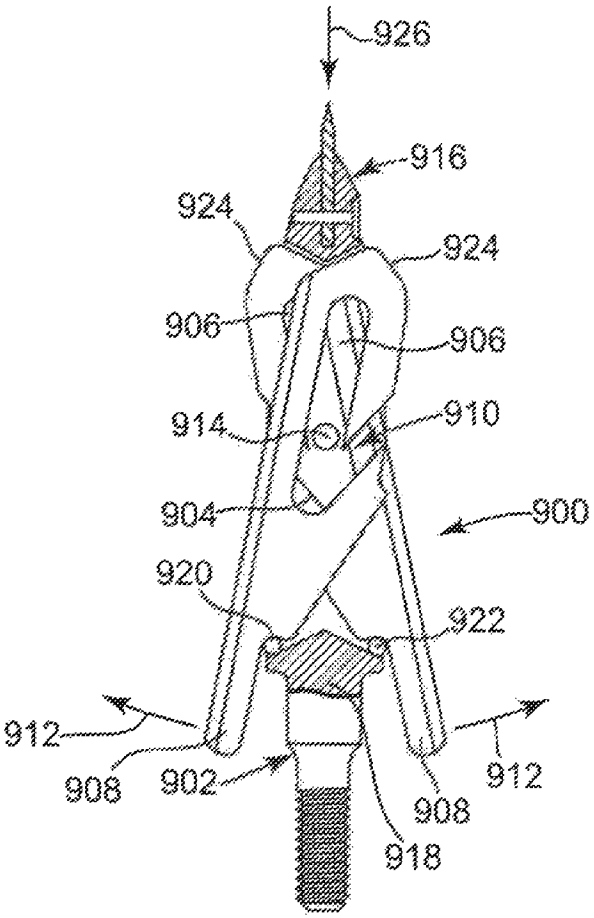
FIG. 27A is a side view of an alternate expandable broadhead in the retracted configuration with quick release cutting blades in accordance with an embodiment of the present invention.

Different deployment profiles are desirable for a variety of reasons, such as for example the nature of the target or game being hunted. The threaded fastener preferably used as the pivot feature on the present expandable broadheads permit quick and easy substitution of blades having different deployment profiles. An alternate blade substitution system is illustrated in FIGS. 27A and 27B. Consequently, a user can be provided a kit including a broadhead body and a plurality of interchangeable blades having different deployment profiles, different length cutting edges, different materials, and the like. For some applications it may be advantageous to attach blades having different deployment profiles to a single broadhead body.

Figure 20:
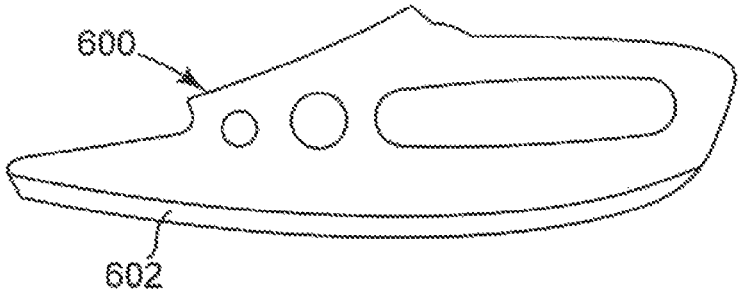
FIGS. 20 and 21 illustrate blades with alternate cutting edges in accordance with an embodiment of the present invention.
Figure 21:
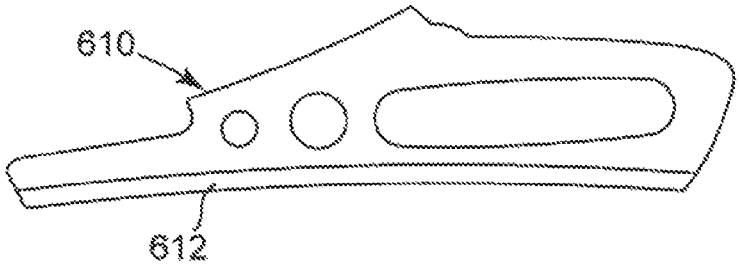

In addition to engineering the deployment profiles, the manufacturing techniques discussed herein permit an infinite variety of cutting edge shapes on the blades. FIGS. 20 and 21 illustrate two exemplary variations of cutting edge shapes. FIG. 20 illustrates a blade 600 with a generally convex curvilinear cutting edge 602. FIG. 21 illustrates a blade 610 with a generally concave curvilinear cutting edge 612. In addition to altering the cutting profile of the blades 600, 610, the curvilinear cutting edges 602, 612 will change the resistance of the blades to fracture.

Figure 22:
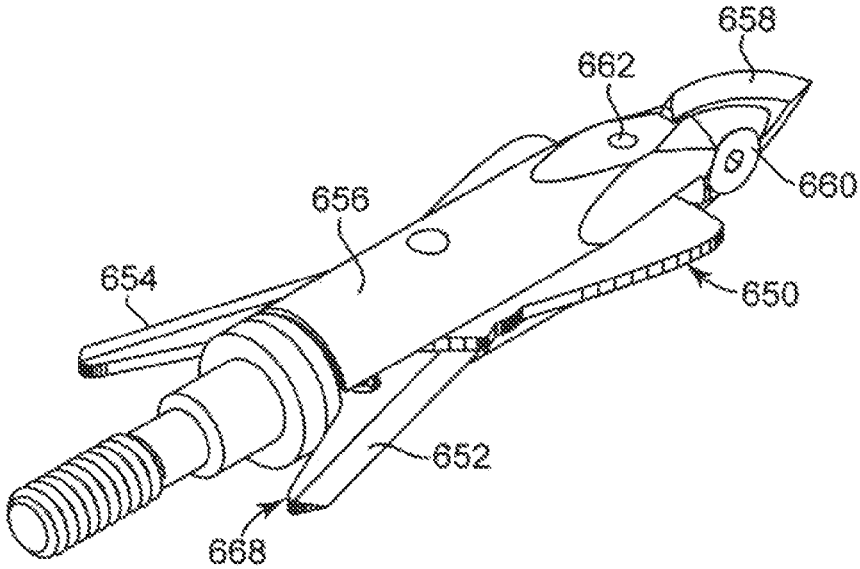
FIG. 22 illustrates a practice broadhead in accordance with an embodiment of the present invention.

FIG. 22 is a perspective view of a practice broadhead 650 in accordance with an embodiment of the present invention. The aerodynamics and flight characteristics of the practice broadhead 650 are substantially the same as the expandable broadhead 50 illustrated in FIG. 2, except the blades 652, 654 and the broadhead body 656 are molded as a single unitary structure in the retracted configuration 668 using one of the manufacturing methods discussed below. In the preferred embodiment, the blades 652, 654 and broadhead body 656 are molded from plastic and metal blade tip 658 is attached with fastener 660. In the preferred embodiment, duplicating similar aerodynamic flight characteristics is typically achieved by creating a practice broadhead with the substantially the same physical characteristics, such as for example shape, weight distribution, air resistance, and the like. It is possible, however, to duplicate similar flight characteristics with a physically different structure.

Because the blades 652, 654 do not deploy, the practice broadhead 650 is easy to remove from a practice target. Wear and tear on the actual expandable broadhead 50 is avoided. The flight characteristics of the practice broadhead 650, however, are substantially the same as the expandable broadhead 50. Consequently, the user can gain experience using the practice broadhead 650 that directly corresponds to use of the expandable broadhead 50. While a molded version of the practice broadhead 650 may not be identical in shape to the expandable broadhead 50, the flight characteristics and weight are substantially the same.

In another embodiment, the practice broadhead 650 is the broadhead 50 illustrated in FIG. 2, except that the blades 652, 654 are secured in the retracted configuration 668 to the broadhead body 656 with an adhesive, fasteners, and the like. Regardless of how the blades are secured, the weight distribution and shape of the practice broadhead 650 are preferably substantially the same as the expandable broadhead 50. Practice broadheads can be made for any expandable broadhead, including the embodiments disclosed herein.

In yet another embodiment, fastener 662 is engaged with broadhead body 656 to secure the blades 652, 654 in the retracted configuration 668 in a practice broadhead mode. Once the fastener 662 is removed, the practice broadhead 650 operates in a rear deploying mode as discussed in connection with the expandable broadhead 50. Consequently, a single structure can be switched from the practice broadhead 650 to the expandable broadhead 50 simply by inserting or removing the fastener 662.

Figure 23:
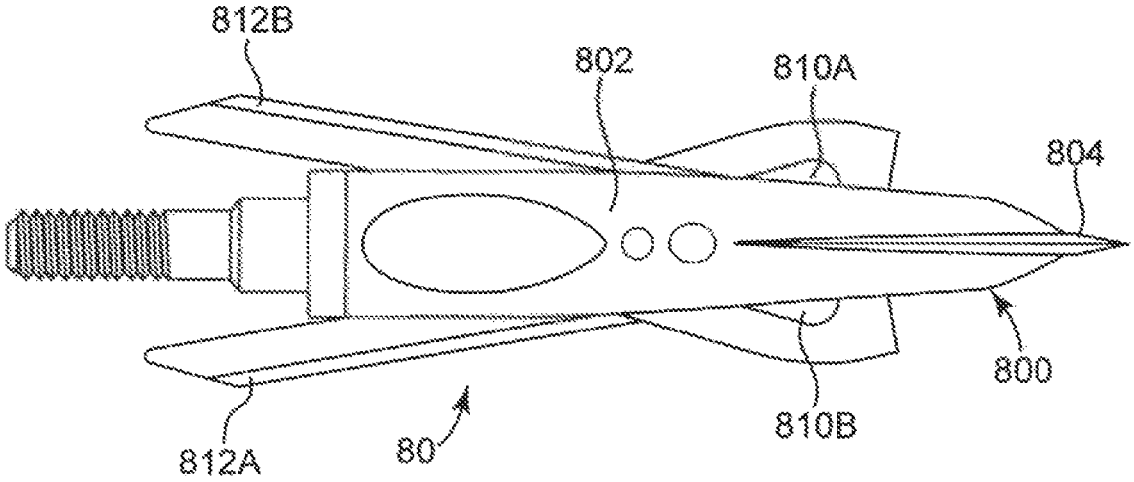
FIG. 23 is a side view of an alternate expandable broadhead in the retracted configuration with a broadhead body made of a polymeric material in accordance with an embodiment of the present invention.
Figure 24:
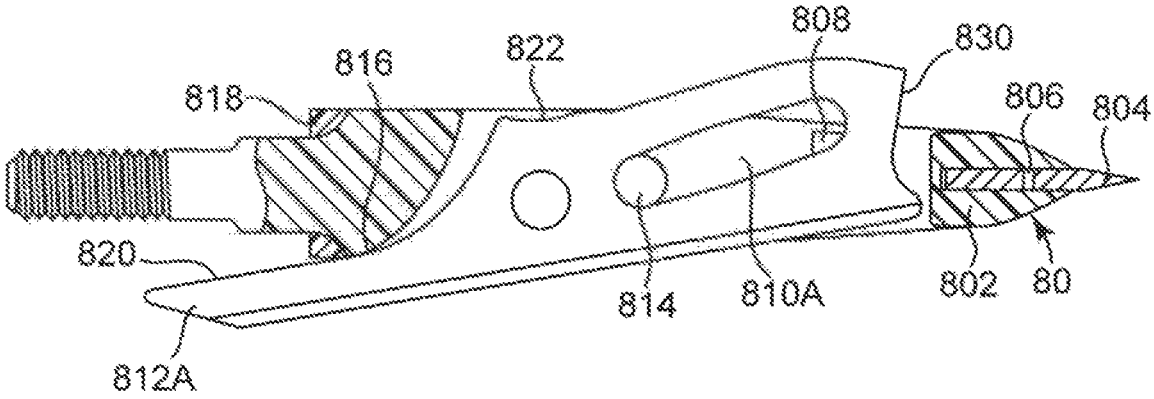
FIG. 24 is a cross-sectional view of the expandable broadhead of FIG. 23.

FIG. 23 is a side view of an alternate expandable broadhead 800 in the retracted configuration 80 with a broadhead body 802 made of a polymeric material in accordance with an embodiment of the present invention. FIG. 24 is a cross-sectional view of the expandable broadhead 800 of FIG. 23.

In the illustrated embodiment, the broadhead body 802 is molded around tip blade 804. Tip blade 804 preferably includes one or more features 806, such as for example cut-out. The polymer preferably flows through the cut-out 806 during the injection molding process to strengthen the attachment to the broadhead body 802. In an alternate embodiment, the features 806 can be a raised structure or protrusion around which the polymeric material flows during molding. Tip blade 804 is preferably made from metal, such as for example stainless steel. Although the present application is directed primarily to expandable broadheads with rear deploying blades, the present broadhead body 802 molded around tip blade 804 is applicable to any type of fixed or expandable broadhead, such as for example the broadheads illustrated in U.S. Pat. Nos. 6,306,053 and 6,743,128 (Liechty).

As best illustrated in FIG. 24, a feature 808 is formed in the broadhead body 802 to engage with slot 810A on the blade 812A in the retracted configuration 80. In the two-blade expandable broadhead 800 of FIGS. 23 and 24, a similar feature 808 is formed on the other half of the broadhead body 802 to engage with slot 810B of the blade 812B. The feature 808 can be a protrusion, detent or other convex structure that penetrates into the slots 810 in the retracted configuration 80. The feature 808 can be integrally molded with the broadhead body 802 or a separate attached feature. The feature 808 is optionally elastically or plastically deformable. It will be appreciated that the blade retaining system of FIGS. 23 and 24 can be used with broadheads made of materials other than polymeric materials, such as for example metal or ceramic.

As illustrated in FIG. 24, the blades 812 engaged with the pivot feature 814, the surface 816 and the feature 808 in the retracted configuration 80. This three-point system secures the blades 812 until impact edge 830 strikes an object.

The surface 816 preferably extends along a portion of the broadhead body 802 and onto member 818. The member 818 is preferably a metal ring that protects the arrow shaft (see FIG. 8) from the impact of the blades 812 on deployment. In another embodiment, the member 818 can be a plastic or elastomeric material that absorbs some of the impact of the blades 812. In one embodiment, the broadhead body 802 plastically deforms as the location 816 upon blade deployment.

Figure 25:
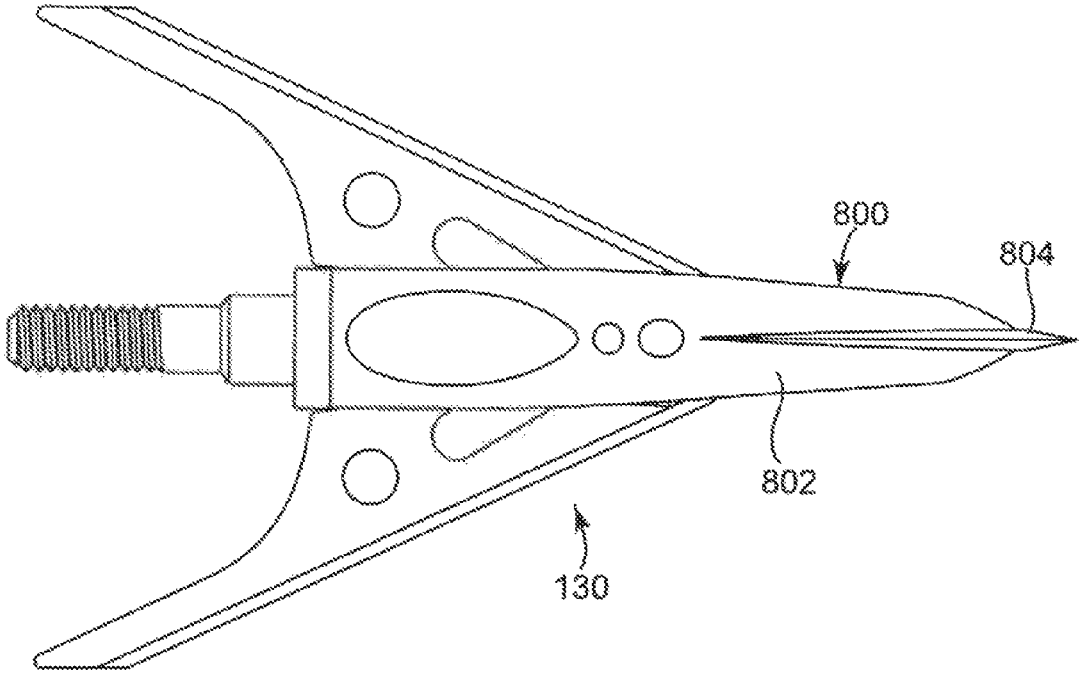
FIG. 25 is a side view of the expandable broadhead of FIG. 23 in the deployed configuration in accordance with an embodiment of the present invention.
Figure 26:
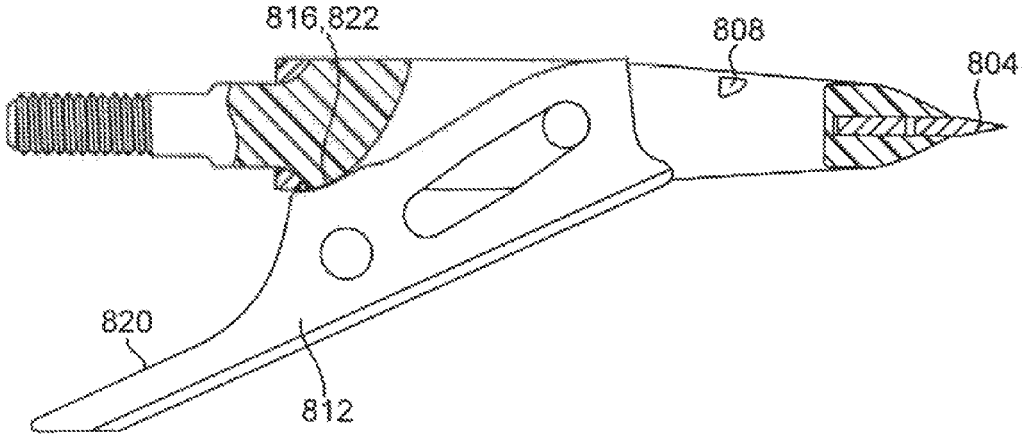
FIG. 26 is a cross-sectional view of the expandable broadhead of FIG. 25.

FIG. 25 is a side view of the expandable broadhead 800 in the deployed configuration 130 in accordance with an embodiment of the present invention. FIG. 26 is a cross-sectional view of the expandable broadhead 800 of FIG. 25. During deployment, caroming edges 820 of the blades 812 travel along surfaces 816. In the illustrated embodiment, deployment regions 822 are a recess engaged with surfaces 816.

FIG. 27A is a side sectional view of an alternate expandable broadhead 900 in the retracted configuration 902 in accordance with an embodiment of the present invention. Slots 906 on blades 908 include cut-outs 910 near the second ends 904. Cut-outs 910 permit the blades 908 to be manually rotated in direction 912 to a position between pivot feature 914 and penetrating end 916. The blades 908 are then disengaged from the pivot feature 914 and removed from the broadhead body 918. The embodiment of FIGS. 27A and 27B permits the blades 908 to be removed and alternate blades substituted without removing the pivot feature 914.

In an alternate embodiment, the pivot feature 914 has a diameter greater than the width of cut-outs 910. The portions of the blades 908 on either side of the cut-out 910 preferably flex to permit the pivot feature 914 to be engaged with, and disengaged from, the slot 906. In another embodiment, pivot feature 914 has a non-cylindrical cross-sectional shape (see e.g., FIGS. 6A and 6B) that permits the blades 908 to be removed only when the blades 908 are positioned in a specific oriented relative to the broadhead body 918, such as for example the blades 908 oriented generally perpendicular to the broadhead body 918.

In the retracted configuration 902, pivot feature 914 is preferably located closer to penetrating end 916 than the cut-out 910 to minimize interference between the cut-out 910 and the pivot feature 914 during deployment. In the illustrated embodiment, notches 920 on the blades 908 engage with retainer 922. Upon impact with an object, impact edges 924 force the blades 908 rearward in direction 926. The pivot feature 914 slides freely generally in the direction 926 in the slot 906. The slot 906 preferably includes a free-floating region.

FIG. 27B is a sectional view of the expandable broadhead 900 of FIG. 27A in the deployed configuration 924. The first ends 926 of the slots 906 are engaged with the pivot feature 914 in the deployed configuration 924. In the illustrated embodiment, deployment regions 930 on the blades 908 engage with the retainer 922. In one embodiment, cantilever portions 932 near the camming edges 934 flex in direction 936 against the retainer 922 and/or the broadhead body 918. In another embodiment, the cantilever portions 932 plastically deform against the broadhead body 918 on impact with an object.

Manufacturing precision blades for expandable broadheads has traditionally been a time consuming and expensive process. The present invention contemplates flexible manufacturing techniques that permits a wide variety of blade shapes and deployment profiles at low cost. In one embodiment, the blades are cut from a sheet or blank of blade stock material. In one preferred embodiment, the blade stock material is a strip of pre-sharpened and/or pre-tempered material, reducing or eliminating the need to sharpen the blade blanks. The blades are preferably made from the blade stock material by laser cutting, electro-discharge machining, water-jet cutting, and other similar techniques that are adaptable to computer control. These computer controlled processes permit the blade shape to be changed essentially instantaneously.

The blade stock material can be made from various different steels, including tool steels; M-2, S-7 & D-2, stainless steels; such as 301, 304, 410, 416, 420, 440A, 440B, 440C, 17-4 PH, 17-7 PH, 13C26, 19C27, G1N4, & other razor blade stainless steels, high speed steel, carbon steels, carbides, titanium alloys, tungsten alloys, tungsten carbides, as well as other metals, ceramics, zirconia ceramics, organic polymers, organic polymer containing materials, plastics, glass, silicone containing compounds, composites, or any other suitable material that a cutting blade or equivalent could be fabricated from, or could be at least in part fabricated from. Various blade manufacturing techniques are disclosed in U.S. Pat. No. 6,743,128 (Liechty) and U.S. Pat. No. 6,939,258 (Muller), which are hereby incorporated by reference.

In one embodiment, the broadhead body or practice broadhead is a unitary molded or machined structure that includes various slots, facets, threads and the like. In an alternate embodiment, the broadhead body or practice broadhead may include a plurality of components that are assembled.

The practice broadhead and the components of the present expandable broadhead can be manufactured using a variety of techniques. In one embodiment, the practice broadhead, broadhead body and/or the rear deploying blades are made using metal injection molding (hereinafter "MIM") techniques, such as disclosed in U.S. Pat. No. 6,290,903 (Grace et al.); U.S. Pat. No. 6,595,881 (Grace et al.); and U.S. Pat. No. 6,939,258 (Muller), which are hereby incorporated by reference. In another embodiment, the practice broadhead, broadhead body and/or the rear deploying blades are made using powder injection molding (hereinafter "PIM") techniques, such as disclosed in U.S. Pat. No. 6,749,801 (Grace et al.), which is hereby incorporated by reference. The powder mixtures used in either the MIM or PIM processes can include metals, ceramics, thermoset or thermoplastic resins, and composites thereof. Reinforcing fibers can optionally be added to the powder mixture.

In another embodiment, the practice broadhead, broadhead body and/or the rear deploying blades are made using other molding techniques, such as injection molding and the methods disclosed in U.S. Pat. No. 5,137,282 (Segar et al.) and U.S. Pat. No. 6,739,991 (Wardropper), which are hereby incorporated by reference. The molding materials can include metals, ceramics, thermoset or thermoplastic resins, and composites thereof. In one embodiment, the broadhead body is molded from the polymers IXEF or AMODEL available from Solvay Advanced Polymers, reinforced by about 30% to about 60% by volume glass or carbon fibers.

Reinforcing fibers can optionally be added to the molding mixture. In one embodiment, the practice broadhead and/or broadhead body are made of carbon fiber reinforced polymers.

Reinforcing fibers can optionally be added to the mixture. Suitable reinforcing fibers include glass fibers, natural fibers, carbon fibers, metal fibers, ceramic fibers, synthetic or polymeric fibers, composite fibers (including one or more components of glass, natural materials, metal, ceramic, carbon, and/or synthetic components), or a combination thereof. In another embodiment, the reinforcing fibers include at least one polymeric component.

The particular embodiments disclosed above are illustrative only, as the invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular embodiments disclosed above may be altered or modified and all such variations are considered within the scope and spirit of the invention.

What is claimed is:

1. An expandable broadhead comprising:

a broadhead body comprising a longitudinal axis and at least one blade recess;

a tip blade releasably attached to the broadhead body;

a plurality of rear deploying blades residing at least in part in the at least one blade recess and slidingly engaged with the broadhead body, the blades each comprising a cutting edge exterior from the broadhead body when in a retracted configuration, and a camming surface effecting a camming action during deployment of the blades from the retracted configuration to a deployed configuration; and a shock-absorbing retainer releasably engaged with at least one feature on the rear deploying blades to retain the rear deploying blades in the retracted configuration, the retainer positioned to engage with the rear deploying blade in the deployed configuration, wherein the retainer comprises one of elastically deformable or plastically deformable.

2. The expandable broadhead of claim 1, wherein the broadhead body comprises one or more of metal, a polymeric material, a fiber reinforced polymer, ceramic, a molded metal injection molded composite; or a combination thereof.

3. The expandable broadhead of claim 1, wherein at least one blade recess comprises a single blade recess having a width sized to receive a pair of rear deploying blades oriented toward opposite sides of the broadhead body.

* * * * *